US007088350B2

(12) United States Patent
Miyazawa

(10) Patent No.: US 7,088,350 B2
(45) Date of Patent: Aug. 8, 2006

(54) DISPLAY DEVICE EMPLOYING TIME-DIVISION-MULTIPLEXED DRIVING OF DRIVER CIRCUITS

(75) Inventor: Toshio Miyazawa, Chiba (JP)

(73) Assignee: Hitachi, Ltd., Tokyo (JP)

( * ) Notice: Subject to any disclaimer, the term of this patent is extended or adjusted under 35 U.S.C. 154(b) by 116 days.

(21) Appl. No.: 10/308,002

(22) Filed: Dec. 3, 2002

(65) Prior Publication Data

US 2003/0107564 A1 Jun. 12, 2003

(30) Foreign Application Priority Data

Dec. 11, 2001 (JP) ..... 2001-376587

(51) Int. Cl.
*G09G 3/36* (2006.01)

(52) U.S. Cl. ..... 345/204; 345/589; 345/88

(58) Field of Classification Search ..... 345/88, 345/98, 100, 204, 205, 206, 600–605
See application file for complete search history.

(56) References Cited

U.S. PATENT DOCUMENTS 4,931,787 A 6/1990 Shannon
5,258,754 A 11/1993 Broderick et al.
5,604,513 A * 2/1997 Takahashi et al. ..... 345/589
5,856,823 A * 1/1999 Kimoto et al. ..... 345/600
5,936,617 A * 8/1999 Uchino et al. ..... 345/204
6,256,004 B1 * 7/2001 Izumi et al. ..... 345/88
2001/0035862 A1 * 11/2001 Nakamura et al. ..... 345/204

FOREIGN PATENT DOCUMENTS

TW 230799 * 1/1993

OTHER PUBLICATIONS

Nakamura et al. "Display Apparatus, Image Control Semiconductor Device, and Method for Driving Display Apparatus," Apr. 27, 2001. U.S. Patent Application Publication.*

* cited by examiner

*Primary Examiner*—Sumati Lefkowitz
*Assistant Examiner*—Tammy Pham
(74) *Attorney, Agent, or Firm*—Reed Smith LLP; Stanley P. Fisher, Esq.; Juan Carlos A. Marquez, Esq.

(57) ABSTRACT

A display device includes a display panel having plural pixels each provided with a thin film transistor and arranged in a matrix configuration in its display area, and a drain driver for supplying video signals to the plural pixels. The drain driver supplies video signals to the plural pixels in a time-division-multiplex fashion based upon the kind of the video signals to be displayed, or based upon the location of plural display blocks forming the display area.

5 Claims, 17 Drawing Sheets

R(A)=R1,R2,···,Rn−1,Rn
R(B)=Rn−1,Rn,···,R2n−3,R2n−2
R(C)=R2n−3,R2n−2,···,R3n−5,R3n−4

DISPLAY DEVICE EMPLOYING TIME-DIVISION-MULTIPLEXED DRIVING OF DRIVER CIRCUITS

BACKGROUND OF THE INVENTION

The present invention relates to a display device using thin film transistors. Among display devices having pixels provided with a thin film transistor and arranged in a matrix configuration, there are liquid crystal display devices using liquid crystal, and display devices of the EL type using electroluminescence.

FIG. 16 shows a first conventional liquid crystal display device using thin film transistors. In this liquid crystal display device, thin film transistors are arranged in an array on one of two opposing transparent glass substrates (not shown), and a transparent counter electrode is disposed on the other of the two opposing transparent glass substrate. The liquid crystal display device needs polarizers and a backlight as its constituent parts in addition to a display panel formed of the two opposing transparent substrates, but those constituent parts are not directly related to the present invention, and therefore in the subsequent explanation, the one of the two substrates formed with the thin film transistors is referred to as the display panel.

In FIG. 16, fabricated on the display panel LCP are a plurality of scanning lines GL extending horizontally and a plurality of drain lines DL extending vertically. Thin film transistors TFT are fabricated in the vicinities of intersections of the scanning lines GL and the drain lines DL. A gate of each of the thin film transistors is connected to a corresponding one of the scanning lines GL, and one of a drain and a source of each of the thin film transistors is connected to a corresponding one of the drain lines DL, and the other of the drain and the source is connected to a pixel electrode. A plurality of pixels each having the thin film transistor TFT and the pixel electrode are arranged in a matrix configuration on the crystal display panel LCP. Shown in FIG. 16 are pixels PXR for displaying red images, pixels PXG for displaying green images, and pixels PXB for displaying blue images coupled to respective scanning lines GL, among the pixels arranged in the matrix configuration. A trio of the pixel PXR, the pixel PXG and the pixel PXB forms a picture dot. In an actual display area DPA, the trios are formed in a repeating configuration.

In operation of displaying, video signals supplied to the drain lines DL are applied to the pixel electrodes by selecting one of the scanning lines GL, and thereby turning on the thin film transistors TFT connected to the selected scanning line GL. As a result, a liquid crystal composition sandwiched between the pixel electrodes and the counter electrode is driven, and thereby light transmission between the pixel electrodes and the counter electrode is controlled, and consequently, a display is produced.

The scanning lines GL extends outside of the display area DPA formed with the pixels arranged in a matrix configuration, and are coupled to gate drivers VSR outside of the left and right sides of the display area DPA. The drain lines DL also extend outside of the display area DPA. In this liquid crystal display device, the drain lines DL coupled to pixels for displaying red, green, and blue images are connected to one terminal of switches SWR, SWG, and SWB, respectively. The other terminals of the three switches SWR, SWG, and SWB connected to the drain lines DL for a red (R) signal, a green (G) signal and a blue (B) signal, respectively, are connected together and connected to one of video signal input terminals VIDEOIN formed on the display panel LCP.

The switches SWR associated with the pixels PXR for displaying red images are controlled by a signal Φ1, the switches SWG associated with the pixels PXG for displaying green images are controlled by a signal Φ2, and the switches SWB associated with the pixels PXB for displaying blue images are controlled by a signal Φ3. All the drain lines DL coupled to the pixels PXR for displaying red in the display area DPA are coupled to corresponding ones of the video signal input terminals VIDEOIN via the respective switches SWR controlled by the signal Φ1, all the drain lines DL coupled to the pixels PXG for displaying green in the display area DPA are coupled to corresponding ones of the video signal input terminals VIDEOIN via the respective switches SWG controlled by the signal Φ2, and all the drain lines DL coupled to the pixels PXB for displaying blue in the display area DPA are coupled to corresponding ones of the video signal input terminals VIDEOIN via the respective switches SWB controlled by the signal Φ3. In other words, each of the video signal input terminals VIDEOIN is coupled to the three drain lines DL coupled to the three pixels for displaying red (R) signals, green (G) signals and blue (B) signals via the three switches SWR, SWG, SWB controlled by the three signals Φ1, Φ2 and Φ3, respectively.

The video signal input terminals VIDEOIN formed on the display panel LCP are connected to terminals of tape carrier packages TCP1, TCP2 and TCP3, and are connected to drain drivers DRV1, DRV2 and DRV3 (numerical suffixes 1, 2, 3, . . . will be sometimes hereinafter dropped where confusion can hardly arise) mounted on the tape carrier packages TCP1, TCP2 and TCP3 via wiring thereon. In FIG. 16, the video signal input terminals VIDEOIN and the terminals of the terminals of the tape carrier packages TCP1, TCP2 and TCP3 are separated from each other, but in practice they are connected to each other as by anisotropic conductive sheets. The three signals Φ1, Φ2 and Φ3 for controlling the switches SWR, SWG and SWB formed on the display panel LCP are supplied from an external control circuit TCON external to the display panel LCP.

FIG. 15 shows an internal structure of the drain driver DRV. The drain driver includes an input latch I-LTC for holding video data in digital form supplied from an external circuit, an output latch P-LTC for receiving the video data from the input latch I-LTC, and digital-to analog converters DAC for converting the video data held in the output latch P-LTC into analog signals for the purpose of supplying video signals to the video signal input terminals VIDEOIN of the display panel LCP.

In this display device explained above, during a period when a given one of the scanning lines GL is selected, first a first kind of video signals supplied from the drain drivers DRV1, DRV2, DRV3 are written into the red-displaying pixels PXR via the switches SWR by turning the signal Φ1 into an ON state, then during the same period when the given one of the scanning lines GL is selected, a second kind of video signals supplied from the drain drivers DRV1, DRV2, DRV3 are written into the green-displaying pixels PXG via the switches SWG by turning the signal Φ2 into an ON state, and then during the same period when the given one of the scanning lines GL is selected, a third kind of video signals supplied from the drain drivers DRV1, DRV2, DRV3 are written into the blue-displaying pixels PXB via the switches SWB by turning the signal Φ3 into an ON state. In other words, during a period when a given one of the scanning lines GL is selected, the drain drivers DRV output video signals for the red-displaying pixels PXR, video signals for the green-displaying pixels PXG, and video signals for the blue-displaying pixels PXB sequentially, in a time-division-multiplexed fashion. This configuration makes it possible to reduce the number of the drain drivers DRV to one third of the number of drain drivers required in a conventional display device.

FIG. 13 shows a second conventional liquid crystal display device. This liquid crystal display device also includes a plurality of scanning lines GL, a plurality of drain lines DL, and a plurality of pixels each provided with a thin film transistor and a pixel electrode, and the scanning lines GL are connected to two gate drivers VSR. This second conventional liquid crystal display device differs from the above-explained first conventional liquid crystal display device in that the display area LCP of the second conventional liquid crystal display device is divided into a plurality of display blocks.

In the second conventional liquid crystal display device, each of the display blocks has a plurality of drain lines DL, each of which is connected to one terminal of a corresponding one of a plurality of switches outside of the display area DPA. The other terminal of each of the switches is connected to a corresponding one of a plurality of drain bus conductors. The switches connected to the drain lines DL in the same display block are controlled by a common signal.

In the second conventional liquid crystal display device, the display area DPA is divided into three display blocks BK1, BK2 and BK3, in each of which n picture dots are coupled to each of the scanning lines GL.

In a first display block BK1 shown in FIG. 13, there are red-displaying pixels PR1, PR2, . . . , PRn, green-displaying pixels PG1, PG2, . . . , PGn, and blue-displaying pixels PB1, PB2, . . . , PBn, all of which are coupled to the same one of the scanning lines GL. The drain lines DL coupled to the red-displaying pixels, the green-displaying pixels, and the blue-displaying pixels are coupled to bus conductors BR1, BR2, . . . , BRn, bus conductors BG1, BG2, . . . , BGn, and bus conductors BB1, BB2, . . . , BBn, of a drain bus, via switching elements SR1, SR2, . . . , SRn, switching elements SG1, SG2, . . . , SGn, and switching elements SB1, SB2, . . . , SBn, respectively, outside of the display area DPA.

In a second display block BK2 shown in FIG. 13, there are red-displaying pixels PRn+1, PRn+2, . . . , PR2*n*, green-displaying pixels PGn+1, PGn+2, . . . , PG2*n*, and blue-displaying pixels PBn+1, PBn+2, . . . , PB2*n*, all of which are coupled to the same one of the scanning lines GL as in the first display block BK1. The drain lines DL coupled to the red-displaying pixels, the green-displaying pixels, and the blue-displaying pixels are coupled to the bus conductors BR1, BR2, . . . , BRn, the bus conductors BG1, BG2, . . . , BGn, and the bus conductors BB1, BB2, . . . , BBn, of the drain bus, via switching elements SRn+1, SRn+2, . . . , SR2*n*, switching elements SGn+1, SGn+2, . . . , SG2*n*, and switching elements SBn+1, SBn+2, . . . , SB2*n*, respectively, outside of the display area DPA.

In a third display block BK3 shown in FIG. 13, there are red-displaying pixels PR2*n*+1, PR2*n*+2, . . . , PR3*n*, green-displaying pixels PG2*n*+1, PG2*n*+2, . . . , PG3*n*, and blue-displaying pixels PB2*n*+1, PB2*n*+2, . . . , PB3*n*, all of which are coupled to the same one of the scanning lines GL as in the first display block BK1. The drain lines DL coupled to the red-displaying pixels, the green-displaying pixels, and the blue-displaying pixels are coupled to the bus conductors BR1, BR2, . . . , BRn, the bus conductors BG1, BG2, . . . , BGn, and the bus conductors BB1, BB2, . . . , BBn, of the drain bus, via switching elements SR2*n*+1, SR2*n*+2, . . . , SR3*n*, switching elements SG2*n*+1, SG2*n*+2, . . . , SG3*n*, and switching elements SB2*n*+1, SB2*n*+2, SB3*n*, respectively, outside of the display area DPA.

As explained above, since there are n bus conductors for red signals, n bus conductors for green signals, and n bus conductors for blue signals, a total of 3n bus conductors are formed outside of the display area DPA. The respective bus conductors of the drain bus are connected to corresponding ones of output terminals of the drain drivers.

On-or-off control of the plural switches SR1, SG1, SB1, SR2, SG2, SB2, . . . , SRn, SGn, SBn coupled between the drain lines in the first display block BK1 and the drain bus is performed by a signal Φ1, on-or-off control of the plural switches SRn+1, SGn+1, SBn+1, SRn+2, SGn+2, SBn+2, . . . , SR2*n*, SG2*n*, SB2*n* coupled between the drain lines in the second display block BK2 and the drain bus is performed by a signal Φ2, and on-or-off control of the plural switches SR2*n*+1, SG2*n*+1, SB2*n*+1, SR2*n*+2, SG2*n*+2, SB2*n*+2, . . . , SR3*n*, SG3*n*, SB3*n* coupled between the drain lines in the third display block BK3 and the drain bus is performed by a signal Φ3. The signals Φ1, Φ2 and Φ3 are supplied by an external control circuit TCON. The drain lines DL in each of the display blocks, the switches coupled between the drain lines DL and the drain bus, the drain bus conductors, and the output terminals of the drain drivers DRV are equal in number. The display blocks BK1, BK2, . . . and the control signals Φ1, Φ2, . . . are equal in number.

In this liquid crystal display device explained above, during a period when a given one of the scanning lines GL is selected, initially a first group of video signals supplied from the drain driver DRV to the drain bus are written into pixels of the first display block BK1 via the switches SR1, SG1, SB1, SR2, SG2, SB2, . . . , SRn, SGn, SBn coupled to the drain lines DL in the first display block BK1 by turning the signal Φ1 into an ON state, then, during the period when the given one of the scanning lines GL is selected, a second group of video signals supplied from the drain driver DRV to the drain bus are written into pixels of the second display block BK2 via the switches SRn+1, SGn+1, SBn+1, SRn+2, SGn+2, SBn+2, . . . , SR2*n*, SG2*n*, SB2*n* coupled to the drain lines DL in the second display block BK2 by turning the signal Φ2 into an ON state, and then, during the period when the given one of the scanning lines GL is selected, a third group of video signals supplied from the drain driver DRV to the drain bus are written into pixels of the third display block BK3 via the switches SR2*n*+1, SG2*n*+1, SB2*n*+1, SR2*n*+2, SG2*n*+2, SB2*n*+2, . . . , SR3*n*, SG3*n*, SB3*n* coupled to the drain lines DL in the third display block BK3 by turning the signal Φ3 into an ON state. In this liquid crystal display device, during a period when a given one of the scanning lines GL is selected, the drain driver DRV outputs the a first group of video signals for the first display block BK1, a second group of video signals for the second display group BK2, and a third group of video signals for the third display block BK3 sequentially, in a time-division-multiplexed fashion. This configuration makes it possible to reduce the number of the drain drivers DRV to one third of the number of drain drivers required in a conventional display device.

In the above-explained two liquid crystal display devices, the display area is divided into a plurality of groups, and during one horizontal scanning period in which one of the scanning lines GL, the driver writes video signals into pixels of respective ones of the plural groups sequentially in a time-division-multiplexed fashion. Consequently, it makes possible to drive the drain lines DL larger in number than output terminals of the drain driver DRV.

Specifically, the first conventional display device divides the video signal lines into three groups of a red (R) signal group, a green (G) signal group and a blue (B) signal group, and thereby its drain driver DRV is capable of driving drain lines DL three times as many as the number of its output terminals. The second conventional display device divides the display area DPA into three parts, and thereby its drain driver DRV is capable of driving drain lines DL three times as many as the number of its output terminals.

SUMMARY OF THE INVENTION

FIG. 17 is a timing chart illustrating signals such as video signal for the first conventional liquid crystal display device. The following explains problems with the first conventional liquid crystal display device by reference to FIGS. 16 and 17. Generally, liquid crystal display devices receive 6-bit digital data I-R for displaying 64-gray-scale red, 6-bit digital data I-G for displaying 64-gray-scale green, and 6-bit digital data I-B for displaying 64-gray-scale blue, in parallel, that is, 18 bits in parallel, from external equipment such as a computer.

In FIG. 17, the video data I-R corresponding to 3n pixels associated with a given one of the scanning lines GL are supplied to the liquid crystal display device sequentially in the order of R1, R2, . . . , Rn, Rn+1, Rn+2, . . . , R2*n*, R2*n*+1, . . . , R3*n*, and the video data I-G corresponding to 3n pixels associated with the given scanning line GL and I-B corresponding to 3n pixels associated with the given scanning line GL are supplied to the liquid crystal display device sequentially in the same manner. Here, the video data I-R, I-G and I-B corresponding to 3n pixels associated with a next one of the scanning lines GL immediately after the above-mentioned given scanning line GL are identified with an added prime notation (′), as R′1, . . . , R′3*n*, G′1, . . . , G′3*n*, B′1, . . . , B′3*n*, respectively, and the video data I-R, I-G and I-B corresponding to 3n pixels associated with one of the scanning lines GL immediately after the above-mentioned next scanning line GL are identified with an added double-prime notation (″), as R″1, . . . , R″3*n*, G″1, . . . , G″3*n*, B″1, . . . , B″3*n*, respectively.

In the liquid crystal display device employing a drain driver having one input latch I-LTC system and one digital-to-analog converter DAC system only, it is necessary to incorporate a video data aligner ALN in front of the drain driver DRV. The video data associated with a given one of the scanning lines GL are supplied to the liquid crystal display device sequentially with specified timing from the external equipment, and this liquid crystal display device needs to select video data to be supplied to red-displaying pixels, video data to be supplied to green-displaying pixels, and video data to be supplied to blue-displaying pixels in synchronism with the signal Φ1, the signal Φ2, and the signal Φ3, respectively, from among the video supplied data, and then convert those digital data into analog data sequentially and output them. However, the above drain driver DRV is not designed to perform this processing, and therefore a circuit exclusive for the above processing needs to be incorporated in front of the drain driver DRV. Video data supplied from the external equipment during one horizontal scanning period H (in FIG. 17, reference sign BLK denotes a blanking period) need to be stored temporarily, and the video data of red (R), green (G) and blue (B) signals need to be selected from among the stored video data, and then they need to be supplied to the drain driver DRV sequentially.

For example, consider video data O1 supplied by the video data aligner ALN to the drain driver DRV1 supplying video signals to first to nth picture dots. The video data O1 includes red-displaying data R1, R2, . . . , Rn selected from among the video data I-R during the period in which a given one of the scanning lines GL is selected, green-displaying data G1, G2, . . . , Gn selected from among the video data I-G during the period in which the given one of the scanning lines GL is selected, and blue-displaying data B1, B2, . . . , Bn selected from among the video data I-B during the period in which the given one of the scanning lines GL, in this order. Video data O2 and O3 supplied by the video data aligner ALN are supplied to the drain driver DRV2 for supplying video signals to (n+1)st to 2nth picture dots and the drain driver DRV3 for supplying video signals to (2n+1)st to 3nth picture dots, respectively, and the video data O2 and O3 include red-displaying data, green-displaying data and blue-displaying data of similar structures.

FIG. 14 is a timing chart illustrating signals such as video signal for the second conventional liquid crystal display device. The following explains problems with the second conventional liquid crystal display device by reference to FIGS. 13 and 14. Generally, the drain drivers DRV take video data into an input latch I-LTC, then transfer the video data stored in the input latch I-LTC into an output latch P-LTC, then convert the digital video data into analog signals, and then supplies to the display panel LCP. Therefor an interval of time is needed for the video data stored in the input latch I-LTC to be transferred to the output latch P-LTC.

However, as shown in FIG. 14, the external equipment outputs video data I-R, I-G, I-B each corresponding to 3n picture dots continuously, and therefore, if the video data I-R, I-G, I-B are supplied to the drain drivers directly from the external equipment, there are not intervals of time required for the video data stored in the input latch I-LTC to be transferred to the output latch P-LTC.

Consequently, the data aligner ALN is needed to be employed in front of the drain driver. The data aligner ALN supplies to the drain driver DRV, video data having added therebetween time intervals required for transfer of the video data between the latches within the drain driver DRV. In FIG. 14, reference sign O-ARR denotes outputs of the data aligner ALN. Conventional data aligners store video data supplied from external equipment in a plurality of memories, process the stored video data, and then supplied the processed video data to drain drivers.

It is a main object of the present invention to provide a display device capable of reducing its cost by reducing the number of components further compared with the conventional display devices by adding a simple structure to the conventional display devices having reduced the number of drain drivers, in view of the problems with the conventional display devices.

The above-mentioned and other objects, and novel features of the present invention will become more apparent by reference to the following description taken in conjunction with the accompanying drawings.

The representative structures of the present invention are as follows:

In accordance with an embodiment of the present invention, there is provided a display device comprising: a plurality of scanning lines; n trios of first, second and third combinations, each of the first combination being formed of a drain line of a first kind intersecting the plurality of scanning lines and a first switch having a first terminal thereof coupled to the drain line of the first kind, the first switch being controlled by a first control signal, each of the second combination being formed of a drain line of a second kind intersecting the plurality of scanning lines and a second switch having a first terminal thereof coupled to the drain line of the second kind, the second switch being controlled by a second control signal, each of the third combination being formed of a drain line of a third kind intersecting the plurality of scanning lines and a third switch having a first terminal thereof coupled to the drain line of the third kind, the third switch being controlled by a third control signal; n nodes, a respective one of the n nodes connecting together second terminals of the first, second and third switches in the respective one of the n trios: a plurality of pixels disposed in vicinities of intersections of the plurality of scanning lines and the drain lines of the first, second and third kinds, a respective one of the plurality of pixels being provided with a thin film transistor having a first terminal thereof coupled to a corresponding one of the drain lines of the first, second and third kinds, a second terminal of the thin film transistor coupled to a corresponding one of the plurality of scanning lines, and a third terminal of the thin film transistor coupled to a pixel electrode of the respective one of the plurality of pixels; and a drain driver for supplying video signals to the N nodes, wherein the drain driver includes a latch circuit of a first kind controlled by a fourth control signal for holding n digital data of a first kind, the n digital data of the first kind being associated with the drain lines of the first kind, respectively, a latch circuit of a second kind controlled by a fifth control signal for holding n digital data of a second kind, the n digital data of the second kind being associated with the drain lines of the second kind, respectively, and a latch circuit of a third kind controlled by a sixth control signal for holding n digital data of a third kind, the n digital data of the third kind being associated with the drain lines of the third kind, respectively; the latch circuit of the first kind, the latch circuit of the second kind, and the latch circuit of the third kind supply signals to the n nodes in a time-division-multiplexed fashion; and the n digital data of the first kind, the n digital data of the second kind, and the n digital data of the third kind are supplied in parallel with each other to the display device.

In accordance with another embodiment of the present invention, there is provided a display device comprising: n red-associated drain lines coupled to a plurality of red-color displaying pixels; n green-associated drain lines coupled to a plurality of green-color displaying pixels adjacent to the plurality of red-color displaying pixels; n blue-associated drain lines coupled to a plurality of blue-color displaying pixels adjacent to the plurality of green-color displaying pixels; a plurality of scanning lines intersecting the n red-associated drain lines, the n green-associated drain lines, and the n blue-associated drain lines; the red-color, green-color and blue-color displaying pixels being disposed in vicinities of intersections of the plurality of scanning lines and the red-associated, green-associated, and blue-associated drain lines, respectively; a respective one of the red-color, green-color and blue-color displaying pixels being provided with a thin film transistor having a first terminal thereof coupled to a corresponding one among the red-associated drain lines, the green-associated drain lines, and the blue-associated drain lines, a second terminal of the thin film transistor coupled to a corresponding one of the plurality of scanning lines, and a third terminal of the thin film transistor coupled a pixel electrode of the respective one of the red-color, green-color and blue-color displaying pixels; n nodes, a respective one of the n nodes connecting together three adjacent drain lines comprising one among the red-associated drain lines, one among the green-associated drain lines, and one among the blue-associated drain lines, via three switches, respectively; an input latch circuit receiving 3n digital video data corresponding to 3n pixels; an output latch circuit for receiving the 3n digital video data from the input latch circuit; and 3n digital-to-analog converters for receiving the 3n digital video data from the output latch circuit and supplying n converted signal to the n nodes in a time-division-multiplexed fashion.

In accordance with another embodiment of the present invention, there is provided a display device comprising: a first display block having n drain lines; a second display block having n drain lines; a plurality of scanning lines common to the first and second display blocks and intersecting the drain lines of the first and second display blocks; a plurality of pixels disposed in vicinities of intersections of the plurality of scanning lines and the drain lines of the first and second display blocks, a respective one of the plurality of pixels being provided with a thin film transistor having a first terminal thereof coupled to a corresponding one of the drain lines of the first and second display blocks, a second terminal of the thin film transistor coupled to a corresponding one of the plurality of scanning lines, and a third terminal of the thin film transistor coupled to a pixel electrode of the respective one of the plurality of pixels; n drain bus conductors, each of the drain bus conductors being coupled to a corresponding one of the drain lines of the first display block via a first switching circuit controlled by a first control signal, and each of the drain bus conductors being coupled to a corresponding one of the drain lines of the second display block via a second switching circuit controlled by a second control signal, n digital-to-analog converters, each of the n digital-to-analog converters being coupled to a respective one of the n drain bus conductors; a latch circuit coupled to the n digital-to-analog converters; and a delay device coupled to the latch circuit, wherein the delay device comprises input terminals for receiving digital video data, a third switching circuit having first terminals coupled to the input terminals, a delay circuit coupled to the input terminals; a fourth switching circuit having first terminals coupled to output terminals of the delay circuit, and output terminals coupled to second terminals of the third switching circuit and second terminals of the fourth switching circuit; and wherein the third switching circuit outputs video data corresponding to the plurality of pixels in one of the first and second display blocks, and the fourth switching circuit outputs digital video data corresponding to the plurality of pixels in another of the first and second display blocks.

In accordance with another embodiment of the present invention, there is provided a display device comprising: m display blocks, each of the m display blocks having 3n drain lines; a plurality of scanning lines common to the m display blocks and intersecting the drain lines of the m display blocks; a plurality of pixels disposed in vicinities of intersections of the plurality of scanning lines and the drain lines of the m display blocks, a respective one of the plurality of pixels being provided with a thin film transistor having a first terminal thereof coupled to a corresponding one of the drain lines of the m display blocks, a second terminal of the thin film transistor coupled to a corresponding one of the plurality of scanning lines, and a third terminal of the thin film transistor coupled to a pixel electrode of the respective one of the plurality of pixels; 3n bus conductors, each of the 3n bus conductors being coupled to a corresponding one of the 3n drain lines of a respective one of the plurality of display blocks via a respective first-type switch controlled by a control signal for selecting one of the m display blocks, the control signal being common to the first-type switches in the respective one of the m display blocks; and k drain drivers, a respective one of the k drain drivers being coupled to the 3n bus conductors via a switch circuit controlled by a control signal for selecting one of the k drain drivers, the switch circuit having 3n second-type switches each connected between a corresponding one of the 3n bus conductors and a corresponding one of 3n output terminals of the respective one of the k drain drivers, wherein each of the k drain drivers is provided with an input latch circuit for receiving digital video data from an external circuit and an output latch circuit for receiving the digital video data from the input latch circuit and for outputting the digital video data to the 3n output terminals, and a respective one of the k drain drivers is configured such that one of the k drain drivers receives digital video data for one of the m display blocks from the external circuit while another of the k drain drivers outputs digital video data previously received for another of the m display blocks to the 3n bus conductors.

In accordance with another embodiment of the present invention, there is provided a display device comprising: p display blocks each having a plurality of drain lines; r display blocks each having a plurality of drain lines; a plurality of scanning lines common to the p and r display blocks and intersecting the drain lines of the p and r display blocks; a plurality of pixels disposed in vicinities of intersections of the plurality of scanning lines and the drain lines of the p and r display blocks, a respective one of the plurality of pixels being provided with a thin film transistor having a first terminal thereof coupled to a corresponding one of the drain lines of the p and r display blocks, a second terminal of the thin film transistor coupled to a corresponding one of the plurality of scanning lines, and a third terminal of the thin film transistor coupled to a pixel electrode of the respective one of the plurality of pixels; a first bus including plural bus conductors and coupled to respective ones of the p display blocks via respective first-type switch circuits controlled by respective control signals; each of the plural bus conductors of the first bus being associated with a corresponding one of the drain lines of the respective ones of the p display blocks; a second bus including plural bus conductors and coupled to respective ones of the r display blocks via respective second-type switch circuits controlled by respective control signals; each of the plural bus conductors of the second bus being associated with a corresponding one of the drain lines of the respective ones of the r display blocks; a first drain driver coupled to the first bus; and a second drain driver coupled to the second bus, wherein the first and second drain drivers supply video signals to the plurality of pixels at times at least partially different from each other.

BRIEF DESCRIPTION OF THE DRAWINGS

In the accompanying drawings, in which like reference numerals designate similar component throughout the figures, and in which.

DETAILED DESCRIPTION OF THE PREFERRED EMBODIMENTS

Figure 1:
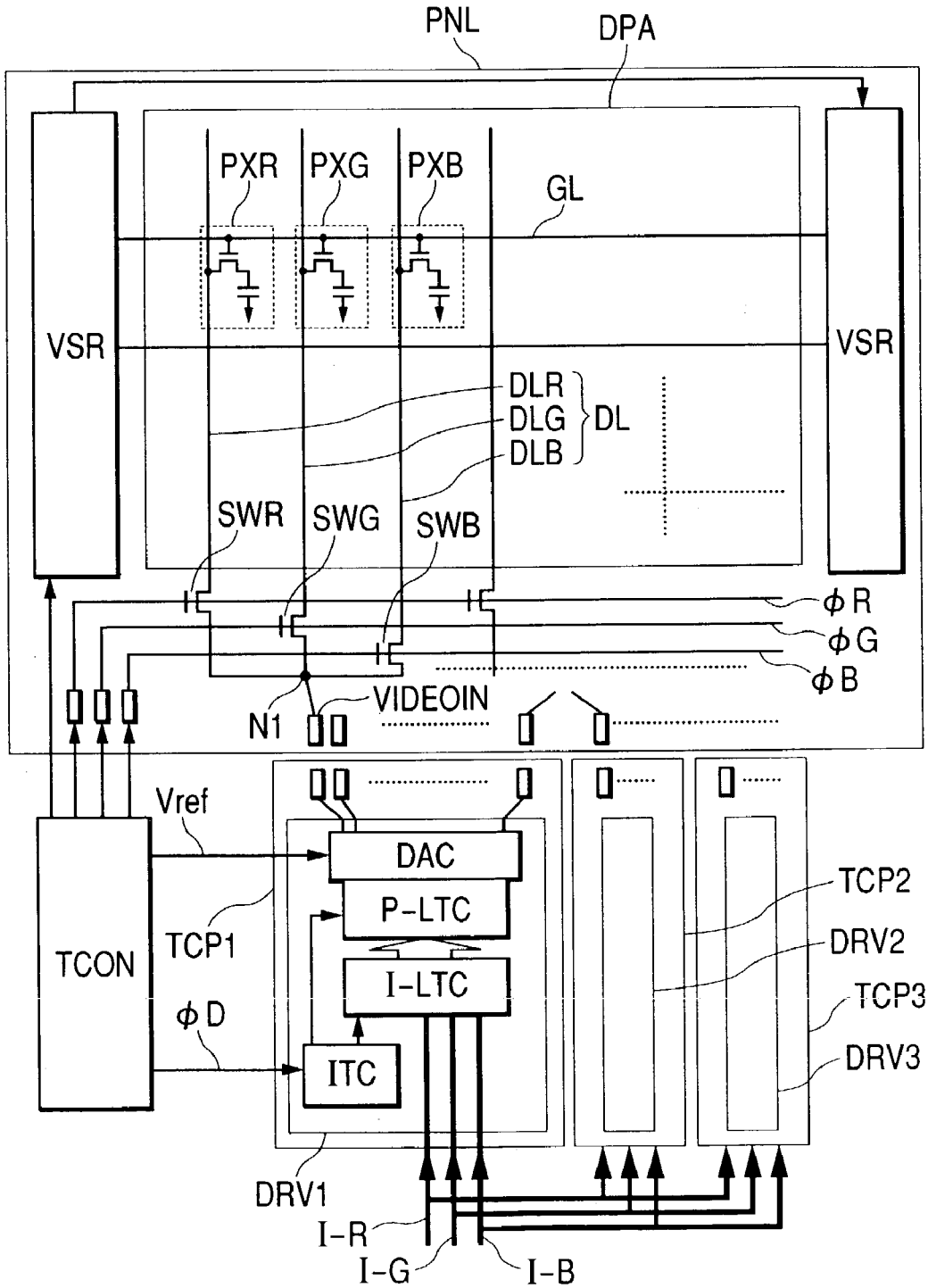
FIG. 1 is a circuit diagram for illustrating a first embodiment of a display device in accordance with the present invention.

The embodiments in accordance with the present invention will now be explained in detail by reference to the drawing.

FIG. 1 illustrates a first embodiment of a display device in accordance with the present invention.

A plurality of scanning lines GL and a plurality of drain lines DL are disposed within a display area DPA of a display panel PNL composed of an insulating substrate such as a glass substrate. A thin film transistor having a gate connected to one of the scanning lines GL, a drain connected to one of the drain lines DL, and a source connected to a pixel electrode is fabricated in each of a plurality of pixels disposed in a matrix configuration in vicinities of the scanning lines GL and the drain lines DL.

Shown in FIG. 1 are only one trio of a red-displaying pixel PXR, a green-displaying pixel PXG and a blue-displaying pixel PXB which are coupled to one of the scanning lines GL, among the plural pixels within the display area. One trio of the three color displaying pixels form one picture dot. Although not shown in FIG. 1, the above-mentioned trios of three color pixels are arranged repeatedly on each of the scanning lines GL. That is to say, one scanning line GL has a plurality of picture dots coupled thereto, and the plural scanning lines GL are arranged in parallel with each other in the vertical direction in FIG. 1 such that the display area DPA is formed. Each of the sources of three transistors of the trio of the three pixels in FIG. 1 is connected to a pixel electrode of a corresponding one of the pixels.

Each of the scanning lines GL fabricated within the display area DPA extends outside of the display area DPA, and is connected to gate drivers VSR outside of the display area DPA. The drain lines DL also extend outside of the display area DPA, and are connected to a switching circuit outside of the display area DPA.

In FIG. 1, the drain line DLR associated with the red-displaying pixel is connected to one terminal of a first switch SWR, the drain line DLG associated with the green-displaying pixel is connected to one terminal of a second switch SWG, and the drain line DLB associated with the blue-displaying pixel is connected to one terminal of a third switch SWR. The other terminals of the three switches SWR, SWG, SWB are connected in common to a first node N1. On-or-off control of the first switch SWR is performed by a first signal ΦR, on-or-off control of the second switch SWG is performed by a second signal ΦG, and on-or-off control of the third switch SWB is performed by a third signal ΦB. A plurality of picture dots are disposed along each of the scanning lines GL as explained above, and in FIG. 1, trios each formed of three drain lines DLR, DLG and DLB and trios each formed of three switches SWR, SWG and SWB controlled by three signals ΦR, ΦG and ΦB, respectively, are arranged repeatedly in a direction of the scanning lines GL. That is to say, there are fabricated nodes equal in number to the picture dots disposed along each of the scanning lines GL. In this specification, consider that a plurality of drain lines DLR coupled to red-displaying pixels form one group, a plurality of drain lines DLG coupled to green-displaying pixels form another group, and a plurality of drain lines DLB coupled to blue-displaying pixels form still another group.

The node N1 to which the other terminals of the first, second and third switches SWR, SWG, SWB are connected is connected to one of terminals VIDEOIN fabricated on the display panel PNL. The number of the terminals VIDEOIN fabricated on the display panel PNL is equal to the number of picture dots arranged along one scanning line GL, that is, one third of the number of pixels coupled to the scanning line GL. Each of the terminals VIDEOIN is connected to respective first terminals of three flexible tape carrier packages TCP1, TCP2 and TCP3 mounting drain drivers DRV1, DRV2 and DRV3. This embodiment employs three tape carrier packages, but the number of the tape carrier packages in the present invention is not limited to three, and can vary according to the number of picture dots in the display panel PNL, or the number of terminals of tape carrier packages. Respective second terminals of the three flexible tape carrier packages TCP1, TCP2 and TCP3 are supplied with video data in parallel from the external equipment or the like. Plural-bit data I-R corresponding to red-displaying pixels, plural-bit data I-G corresponding to green-displaying pixels, and plural-bit data I-B corresponding to blue-displaying pixels are supplied in parallel to the liquid crystal display device from equipment (not shown) external to the liquid crystal display device.

For example, in a case where each of three pixels for displaying red (R), green (G) and blue (B) produces 64-gray-scale images, that is, in a case where one picture dot produces about 260,000 different colors, digital data for each of the pixels are formed of 6 bits, and therefore the external equipment outputs 18-bit video data corresponding to one picture dot at the same time. The video data supplied to the tape carrier packages TCP1, TCP2, TCP3 are supplied to the drain drivers DRV1, DRV2, DRV3 mounted thereon. The drain drivers DRV1, DRV2, DRV3 convert the supplied digital video data into analog video signals, and then supply the converted video signals to corresponding ones of the pixels PXR, PXG, PXB via the terminals VIDEOIN, the nodes N1, . . . , the switches SWR, SWG, SWB, and the drain lines DLR, DLG, DLB, fabricated on the display panel PNL.

In this embodiment, the drain driver DRV1, for example, among the drain drivers DRV1, DRV2, DRV3, is fabricated on one semiconductor chip, and the semiconductor chip is mounted on the tape carrier package TCP1, but the semiconductor chip having the drain driver DRV1 fabricated thereon can be attached directly on the display panel PNL.

Each of the drain drivers DRV1, DRV2, DRV3 includes an input latch I-LTC for receiving in synchronism with a clock signal, 18-bit video data in parallel corresponding to one picture dot at a time, and sequentially supplied from the external equipment, an output latch P-LTC for receiving the entire video data stored in the input latch I-LTC at a time and storing them, and digital-to-analog converters DAC for converting the video data stored in the output latch P-LTC to analog video signals, and an internal control circuit ITC for controlling the input latch I-LTC and the output latch P-LTC based upon an externally supplied signal ΦD.

The display device of this embodiment further includes an external control circuit TCON for supplying signals controlling shift registers included in the gate drivers VSR and supplying the first, second and third signals ΦR, ΦG, ΦB controlling the switching circuits SWR, SWG, SWB fabricated on the display panel PNL. This external control circuit TCON supplies the signal ΦD to the internal control circuit ITC within the drain driver DRV, and supplies to the digital-to-analog converters DAC a reference voltage Vref for producing gray-scale video signals to be supplied to pixels.

Figure 2:
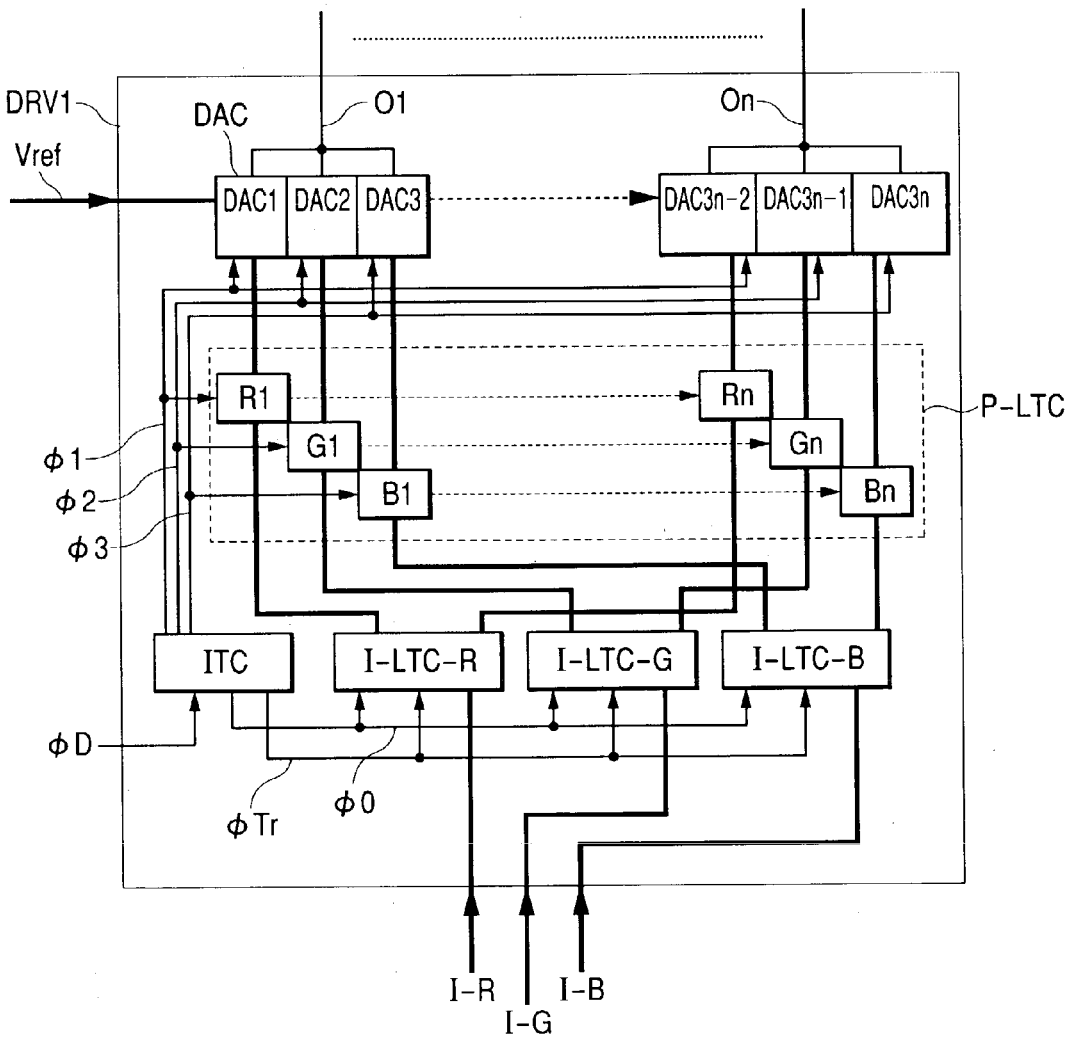
FIG. 2 is a block diagram for illustrating a drain driver in the first embodiment of a display device in accordance with the present invention.

FIG. 2 shows a detailed structure of the drain driver DRV1 as an example, among the drain drivers DRV1, DRV2, DRV3 shown in FIG. 1. The three drain drivers DRV1, DRV2, DRV3 are shown in FIG. 1, they are identical in structure, and only the drain driver DRV1 will be explained. Three video data I-R, I-G and I-B are input in parallel into the drain driver DRV1. Although not shown in detail, in a case in which each of the pixels produces 64-gray-scale images, the drain driver DRV1 requires 18 input terminals for one picture dot. If the drain driver DRV1 is configured to receive video data corresponding to two picture dots in parallel at a time, 36 input terminals will be needed. Whether video data corresponding to one picture dot or two picture dots are configured to be input in parallel depends upon a tradeoff between the operating speed of the drain driver DRV1 and the number of its input terminals, and therefore the number of picture dots whose video data are input in parallel is not relevant to the present invention.

The input video data are successively taken into the input latch I-LTC. The input latch I-LTC comprises a red video data latch I-LTC-R, a green video data latch I-LTC-G, and a blue video data latch I-LTC-B associated with red (R) signals, green (G) signals, and blue (B) signals, respectively. The respective data latches I-LTC-R, I-LTC-G, I-LTC-B take in video data in synchronism with a clock signal ΦTr from the internal control circuit ITC.

After each of the input data latches I-LTC-R, I-LTC-G, I-LTC-B has received video data corresponding to the predetermined number n of picture dots, which corresponds to 3n pixels, it transfers to the output latch P-LTC the video data corresponding to n pixels (which correspond to 6n bits in a case where one pixel produces 64-gray-scale images) stored in a corresponding one of the red (R), green (G), and blue (B) input data latches, I-LTC-R, I-LTC-G, I-LTC-B.

Each of the red video data corresponding to one of the pixels among the red video data stored in the red video data input latch I-LTC-R is transferred to and stored in a corresponding one of red latch elements R1, R2, . . . ., Rn within the output data latch P-LTC. Each of the green video data corresponding to one of the pixels among the green video data stored in the green video data input latch I-LTC-G is transferred to and stored in a corresponding one of green latch elements G1, G2, . . . , Gn within the output data latch P-LTC. Each of the blue video data corresponding to one of the pixels among the blue video data stored in the blue video data input latch I-LTC-B is transferred to and stored in a corresponding one of red latch elements B1, B2, . . . , Bn within the output data latch P-LTC.

The video data stored in the 3n latch elements within the output latch P-LTC are converted to analog video signals representing gray scales based upon the video data by the digital-to-analog converters DAC coupled to the respective corresponding ones of the latch elements. N digital-to-analog converters labeled DAC1, DAC4, DAC7, . . . , DAC3*n*−2 coupled to the n red latch elements R1, R2, . . . , Rn, respectively, output the video signals converted from the video data stored in the n red latch elements in synchronism with a signal Φ1. Thereafter, n digital-to-analog converters labeled DAC2, DAC5, DAC8, . . . , DAC3*n*−1 coupled to the n green latch elements G1, G2, . . . , Gn, respectively, output the video signals converted from the video data stored in the n green latch elements in synchronism with a signal Φ2, and thereafter, n digital-to-analog converters labeled DAC3, DAC6, DAC9, . . . , DAC3*n* coupled to the n blue latch elements B1, B2, . . . , Bn, respectively, output the video signals converted from the video data stored in the n blue latch elements in synchronism with a signal Φ3.

By performing the above processing, the digital video data corresponding to n picture dots are converted to analog video signals, and are supplied in the form of red video signals corresponding to n red-displaying pixels, green video signals corresponding to n green-displaying pixels, and blue video signals corresponding to n blue-displaying pixels to the display panel PNL via output terminals O1, O2, . . . , On of the drain driver DRV1.

The internal control circuit ITC supplies the signals Φ1, Φ2, Φ3 to the output latch P-LTC and the digital-to-analog converters DAC, the signals Φ1, Φ2, Φ3 can be generated in various ways, and can be generated by counting clocks contained in the supplied video data, or cocks supplied by the external control circuit. A method of generating the signals Φ1, Φ2, Φ3 is not limited to that explained in connection with this embodiment.

The external equipment supplies video data corresponding to 3n picture dots associated with one of the scanning lines GL of the display panel PNL continuously. Therefore, in this embodiment, each of the three drain drivers DRV1, DRV2 and DRV3 coupled to the display panel PNL takes into its input latch I-LTC, video data corresponding to n picture dots at a respective time in a time-division-multiplexed fashion, among video data corresponding to 3n picture dots supplied from the external equipment. Therefore operation-starting times of the three input latches I-LTC within the drain drivers DRV1, DRV2 and DRV3, respectively, differ from each other. The operation-starting clocks can be supplied to the respective drain drivers DRV1, DRV2, and DRV3 from the external control circuit TCON, or the input latch I-LTC within one of the drain drivers can be configured to start its operation based upon a signal from another of the drain drivers indicating completion of operation of its input latch. However, it is desirable that each of the signals Φ1, Φ2 and Φ3 with which three color video signals are supplied from the drain drivers DRV1, DRV2, DRV3 to the display panel PNL in synchronism, is common in the three drain drivers DRV1, DRV2, DRV3.

Figure 3:
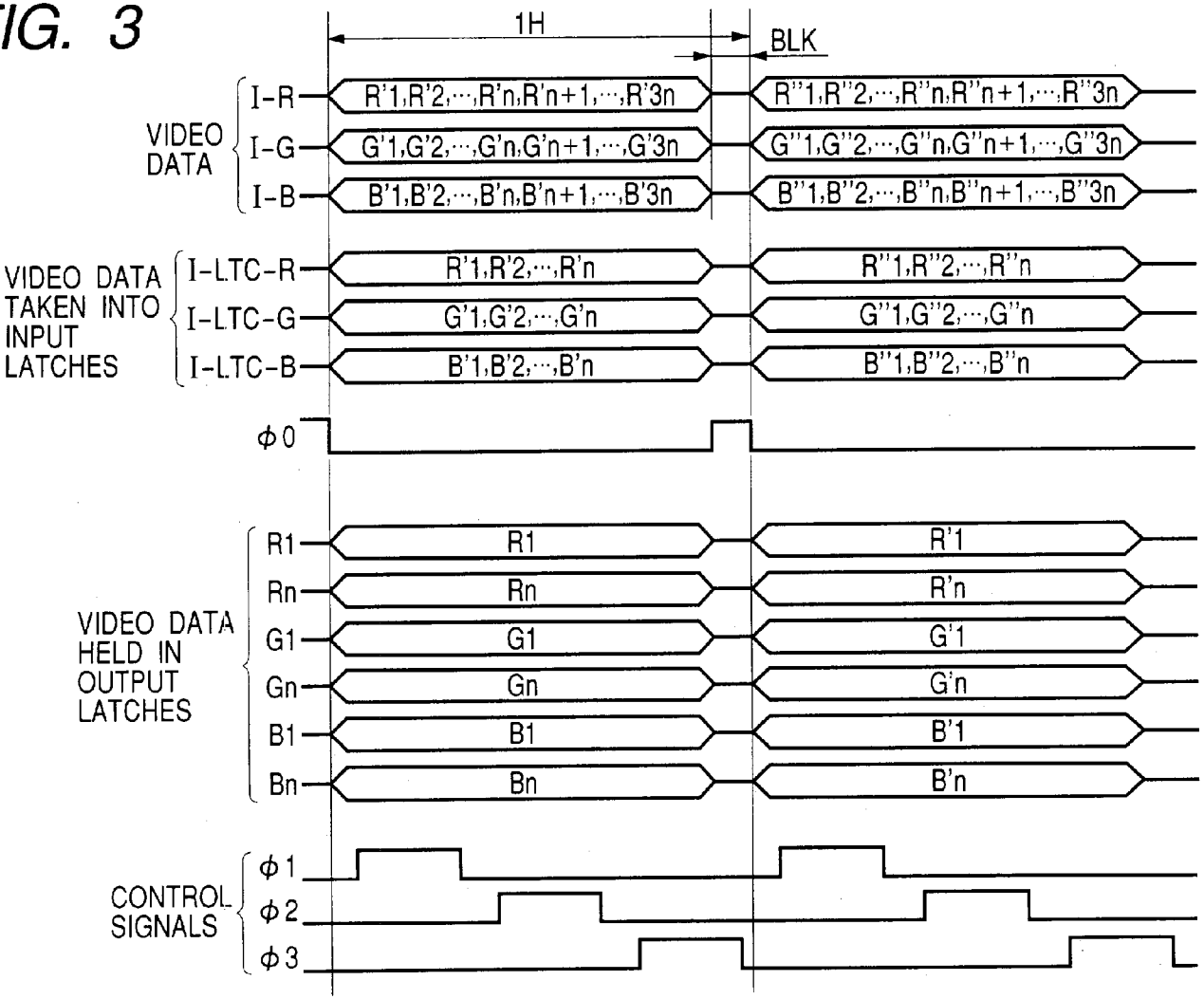
FIG. 3 is a timing chart for explaining the first embodiment of a display device in accordance with the present invention.

FIG. 3 explains timing relationships between signals in the display device of this embodiment in conjunction with FIGS. 1 and 2. The display panel PNL shown in FIG. 1 is capable of displaying 3n picture dots in a direction of the scanning lines GL. Therefore, formed on the display panel PNL are 3n switches SWR coupled to the drain lines DLR associated with red-displaying pixels, 3n switches SWG coupled to the drain lines DLG associated with green-displaying pixels, and 3n switches SWB coupled to the drain lines DLB associated with blue-displaying pixels. There are 3n nodes N1 each of which connects together terminals of three adjacent switches SWR, SWG and SWB. The three drain drivers DRV1, DRV2, DRV3 for supplying video signals are coupled to the 3n nodes N1. Each of the drain drivers DRV1, DRV2, DRV3 is capable of driving n picture dots, that is, 3n pixels, in a horizontal direction.

In FIG. 3, I-R, I-G, and I-B represent red, green, and blue video data, respectively, supplied to the display device of this embodiment from the external equipment. Video data corresponding to 3n red-displaying pixels associated with one of the scanning lines GL are supplied sequentially as denoted by symbols R'1, R'2, . . . , R'n, R'n+1, . . . , R'3*n*, video data corresponding to 3n green-displaying pixels associated with the one of the scanning lines GL are supplied sequentially as denoted by symbols G'1, G'2, . . . , G'n, G'n+1, . . . , G'3*n*, and video data corresponding to 3n blue-displaying pixels associated with the one of the scanning lines GL are supplied sequentially as denoted by symbols B'1, B'2, . . . , B'n, B'n+1, . . . , B'3*n*. A period during which video data corresponding to 3n picture dots formed on a given scanning line GL are supplied is represented by a symbol H, and a blanking time BLK is defined as a time interval after completion of supply of the video data corresponding to the given scanning line GL to the start of supply of video data corresponding to the next scanning line GL. Here the symbol R'1 represents video data to be displayed on the first red-displaying pixel coupled to a given scanning line GL, and the symbol R'n denotes video data to be displayed on the nth red-displaying pixel coupled to the given scanning line GL. The symbol R"1 and R"n represent video data to be displayed on the first and nth red-displaying pixels coupled to the next scanning line GL, respectively, and the symbol R1 and Rn denote video data to be displayed on the first and nth red-displaying pixel coupled to the scanning line immediately preceding the given scanning line GL, respectively. G'1, G'n, G"1, G"n, G1, Gn, B'1, B'n, B"1, B"n, B1, and Bn denote the video data analogously.

Video data corresponding to 3n picture dots associated with one of the scanning lines GL are supplied in parallel to the three drain drivers DRV1, DRV2, DRV3 provided on the display panel PNL, the first drain driver DRV1 takes into its input latch I-LTC video data corresponding to the first to nth picture dots among the 3n picture dots, the second drain driver DRV2 takes into its input latch I-LTC video data corresponding to the (n+1)st to 2nth picture dots among the 3n picture dots, and the third drain driver DRV3 takes into its input latch I-LTC video data corresponding to the (2n+1)st to 3nth picture dots among the 3n picture dots. This operation is repeated for video data associated with the remainder of the scanning lines GL.

In FIG. 3, I-LTC-R, I-LTC-G and I-LTC-B represent video data taken into the input latches I-LTC-R, I-LTC-G and I-LTC-B of the first drain driver DRV1, respectively. After the video data corresponding to one H period are taken into the input latches I-LTC of the first, second and third drain drivers DRV1, DRV2, DRV3, the video data stored in the input latches I-LTC-R, I-LTC-G, I-LTC-B within each of the drain drivers DRV1, DRV2, DRV3 are transferred to the output latches P-LTC in synchronism with a signal Φ0 indicated in FIGS. 2 and 3. In FIG. 3, R1, . . . , Rn, G1, . . . , Gn, and B1, . . . , Bn represent video data stored in the output latch elements R1, . . . , Rn, G1, . . . , Gn, and B1, . . . , Bn within the drain driver DRV1, respectively.

The transfer of the video data from the input latch I-LTC to the output latch P-LTC is performed after the video data corresponding to the one scanning line GL have been supplied to all of the three drain drivers DRV1, DRV2, DRV3, and therefore video data stored in the output latch P-LTC during a given period is video data corresponding to one of the scanning lines GL immediately preceding another of the scanning line GL associated with video data the input latch I-LTC is taking in during the given period.

In a state in which the output latch P-LTC holds the video data, the signals Φ1, Φ2, and Φ3 are sequentially turned into ON-states as shown in FIG. 3, where the signal Φ1 is supplied to the latch elements R1, R2, . . . , Rn for storing red-displaying video data, the signal Φ2 is supplied to the latch elements G1, G2, . . . , Gn for storing green-displaying video data, and the signal Φ3 is supplied to the latch elements B1, B2, . . . , Bn for storing blue-displaying video data. With this operation, when the signal Φ1 is in the ON state, the red-displaying video data stored in the latch elements R1, R2, . . . , Rn are converted to analog video signals by digital-to-analog converters DAC1, DAC4, . . . , DAC3$n$−2, respectively, and are output via output terminals O1, O2, . . . , On of the drain driver DRV1, thereafter when the signal Φ2 is in the ON state, the green-displaying video data stored in the latch elements G1, G2, . . . , Gn are converted to analog video signals by digital-to-analog converters DAC2, DAC5, . . . , DAC3$n$−1, respectively, and are output via output terminals O1, O2, . . . , On of the drain driver DRV1, and thereafter when the signal Φ43 is in the ON state, the blue-displaying video data stored in the latch elements B1, B2, . . . , Bn are converted to analog video signals by digital-to-analog converters DAC3, DAC6, . . . , DAC3$n$, respectively, and are output via output terminals O1, O2, . . . , On of the drain driver DRV1.

The signals ΦR, ΦG, ΦB for controlling the switching circuits SWR, SWG, SWB coupled to the output terminals of the drain driver DRV1 are turned into ON states in synchronism with the signals Φ1, Φ2, Φ3 for controlling the output latch P-LTC and the digital-to-analog converters DAC within the drain driver DRV1, respectively, such that the switching circuits SWR, SWG, SWB are made conducting.

In FIG. 1, the video signal corresponding to the red-displaying video data are output based upon the signal Φ1 from the red-associated digital-to-analog converters DAC of the three drain drivers DRV1, DRV2, DRV3, and are supplied to corresponding ones of the red-displaying pixels PXR via corresponding ones of the 3n first switches SWR turned ON by the signal ΦR. Thereafter, the first switches SWR are turned OFF based upon the signal ΦR, and the outputs from the digital-to-analog converters DAC associated with the red-displaying data within the drain drivers DRV1, DRV2, DRV3 are ceased by the signal Φ1. Thereafter the video signal corresponding to the green-displaying video data are output based upon the signal Φ2 from the green-associated digital-to-analog converters DAC of the three drain drivers DRV1, DRV2, DRV3, and are supplied to corresponding ones of the green-displaying pixels PXG via corresponding ones of the 3n second switches SWG turned ON by the signal ΦG. Thereafter, the second switches SWG are turned OFF based upon the signal ΦG, and then the outputs from the digital-to-analog converters DAC associated with the green-displaying data within the drain drivers DRV1, DRV2, DRV3 are ceased by the signal Φ2. Thereafter the video data corresponding to the blue-displaying video data are output based upon the signal Φ3 from the blue-associated digital-to-analog converters DAC of the three drain drivers DRV1, DRV2, DRV3, and are supplied to corresponding ones of the blue-displaying pixels PXB via corresponding ones of the 3n third switches SWB turned ON by the signal ΦB. Thereafter, the second switches SWB are turned OFF based upon the signal ΦB, and then the outputs from the digital-to-analog converters DAC associated with the blue-displaying data within the drain drivers DRV1, DRV2, DRV3 are ceased by the signal Φ3. The above operation is repeated for each of the scanning lines GL to produce images in the display area DPA. It is desirable that the video signals corresponding to a given one of the scanning lines GL from the respective drain drivers DRV1, DRV2, DRV3 are supplied to the corresponding ones of the nodes N1 of the display panel PNL in synchronism with each other, and that the signals Φ1, Φ2 and Φ3 for one of the drain drivers DRV1, DRV2, DRV3 are in synchronism with the corresponding ones of the signals Φ1, Φ2 and Φ3 for the others of the drain drivers DRV1, DRV2, DRV3.

In conventional display devices in which red (R) video data, green (G) video data and blue (B) video data are supplied sequentially, and then drain drivers supply red (R) video signals, green (G) video signals and blue (B) video signals to pixels in a time-division-multiplexed fashion as in the case of this embodiment, it is necessary to add a data aligner in front of the drain drivers DRV which divides video data into red (R) data, green (G) data and blue (B) data, and then supplies the divided data to the drain drivers.

However, in the display device of this embodiment in accordance with the present invention, the drain driver DRV includes an input latch and an output latch which are capable of storing video data corresponding to pixels equal in number to three times the number of video data output by the drain driver DRV at a time, and digital-to-analog converters equal in number to three times the number of video data output by the drain driver DRV at a time, and consequently, the number of parts required of the conventional display devices can be reduced.

The number of picture dots associated with one scanning line GL varies with the size of the display panel PNL and display resolution, and therefore, in the conventional display devices, the structure of the data aligner implemented in front of the drain driver DRV needs to be modified according to variation in number of the picture dots. However, in the display device of this embodiment, the need for the data aligner is eliminated, and it is merely necessary that video data are supplied in parallel with each other to the drain driver DRV as in the case of the conventional display devices not employing a time-division-multiplexed driving. Consequently, the display device of this embodiment is capable of coping easily with diversification of specifications of display devices.

In the above-explained first embodiment, the input latch and the output latch which are capable of storing video data corresponding to 3n pixels are provided in the drain driver DRV configured to supply video signals to n pixels at a time, where each of the video data corresponding to one pixel is composed of plural bits, and 3n digital-to-analog converters DAC are provided to each of the output latches. The digital video data corresponding to red (R) pixels, green (G) pixels, and blue (B) pixels are converted to analog signals in a time-division-multiplexed fashion. Therefore the configuration can be modified such that one digital-to-analog converter DAC is provided to three red (R), green (G) and blue (B) pixels in common. In this case, the operating speed of the digital-to-analog converters DAC needs to be increased, and the total area occupied by the digital-to-analog converters DAC within the drain driver DRV can be reduced.

In this embodiment, three video signal line driver circuits capable of supplying video signals to n picture dots, that is, 3n pixels, are coupled to the display panel PNL in which 3n picture dots are coupled to one scanning line GL, but the present invention is not limited to this configuration. For example, one drain driver DRV capable of supplying video data to n picture dots can be coupled to the display panel PNL for displaying n picture dots in one scanning line, or two drain drivers DRV capable of supplying video data to n picture dots can be coupled to the display panel PNL for displaying 2*n* picture dots in one scanning line.

In this embodiment, three drain lines DL corresponding to red (R), green (G) and blue (B) signals associated with one picture dot are driven in a time-division-multiplexed fashion during a period in which one scanning line GL is selected. However, six drain lines DL corresponding to two picture dots can be driven in a time-division-multiplexed fashion during a period in which one scanning line GL is selected. In this case, six kinds of switches coupled to six adjacent drain lines DL, respectively and controlled by six signals in a time-division-multiplexed fashion need to be provided to the display panel PNL, and latch elements and digital-to-analog converters DAC within each of the drain drivers DRV need to be equal in number to twice the numbers of those in the case of FIG. 2.

In the first embodiment, the signals ΦR, ΦG, ΦB for controlling the switches SWR, SWG, SWB on the display panel PNL, a signal for controlling the gate drivers VSR are supplied from the external control circuit TCON, and the signal ΦD supplied to the drain drivers DRV1, DRV2, DRV3 and the reference voltage Vref supplied to the digital-to-analog converters DAC are also supplied from the external control circuit TCON. The signals Φ1, Φ2, Φ3 and ΦTr for controlling the latches I-LTC, P-LTC, the digital-to-analog converters DAC within the drain drivers DRV are generated based upon the signal ΦD supplied from the external control circuit TCON, within the internal control circuit ITC within the drain drivers DRV. The places where the above control signals are generated are not limited to those in this embodiment. All the above control signals can be generated based upon external control signals.

Figure 4:
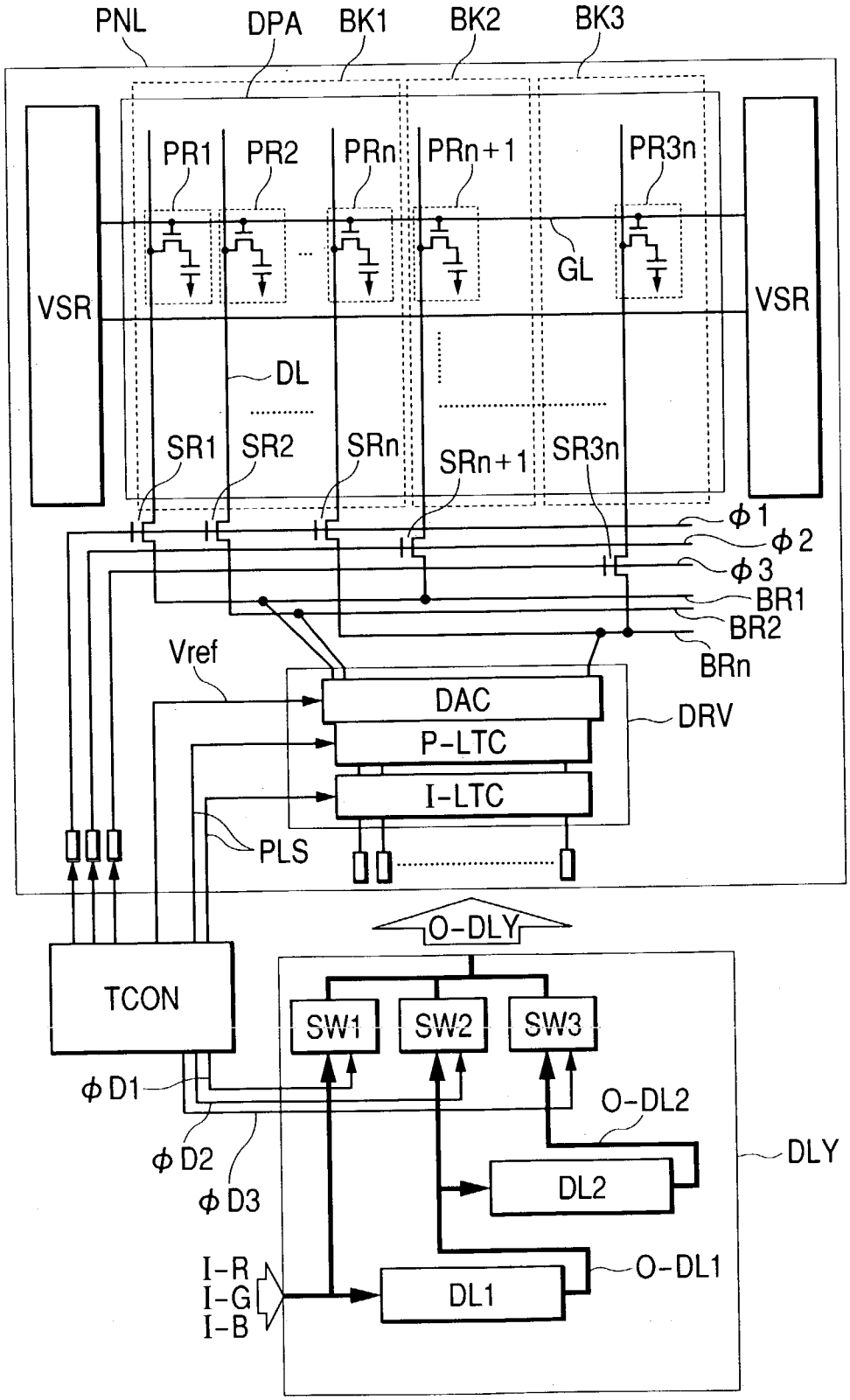
FIG. 4 is a circuit diagram for illustrating a second embodiment of a display device in accordance with the present invention.

FIG. 4 illustrates a second embodiment of a display device in accordance with the present invention. Formed in the display area on the display panel PNL are a plurality of scanning lines GL, a plurality of video signal lines (hereinafter drain lines) DL, and a plurality of pixels arranged in a matrix configuration and each provided with a thin film transistor having a gate connected to a corresponding one of the scanning lines GL, a drain connected to a corresponding one of the drain lines DL, a source connected to a pixel electrode of a corresponding one of the pixels. In this embodiment, the display area DPA is divided into a first display block BK1, a second display block BK2 and a third display block BK3 arranged in direction of the scanning lines GL. In each of the display blocks BK1, BK2, BK3, n picture dots, that is, 3n pixels are formed in the direction of the scanning lines GL, and this means that 3n drain lines DL are disposed in each of the display blocks BK1, BK2, BK3. FIG. 4 shows, among pixels associated with one scanning line GL, the first red-displaying pixel PR1, the second red-displaying pixel PR2, and the nth red-displaying pixel PRn in the first display block BK1, the (n+1)st red-displaying pixel PRn+1 in the second display block BK2 (although this pixel is the first red-displaying pixel in the second display block BK2, this continuous labeling system is employed hereinafter for simplicity of explanation), and the 3nth red-displaying pixel PR3*n* in the third display block BK3. Although omitted in FIG. 4, the ith green-displaying pixel PGi and a drain line DL coupled thereto and the ith blue-displaying pixel PBi and a drain line coupled thereto are disposed between the ith red-displaying pixel PRi and the (i+1)st red-displaying pixel PRi+1, where n=1, 2, 3, . . . . The scanning lines GL disposed in the display area DPA are connected to the gate drivers VSR outside of the display area DPA. The drain lines DL also extend outside of the display area DPA and are connected to the switching circuit SR1, SR2, . . . , SR3*n* outside of the display area DPA.

The drain lines DL in the first display block BK1 are connected to the respective first terminals of a first switching circuit, the drain lines DL in the second display block BK2 are connected to the respective first terminals of a second switching circuit, and the drain lines DL in the third display block BK3 are connected to the respective first terminals of a third switching circuit. The respective second terminals of the first, second and third switching circuits are connected to corresponding bus conductors of a bus.

The drain line DL coupled to the first red-displaying pixel PR1 in the first display block BK1 is connected to a first bus conductor BR1 of the drain bus via the first switch SR1 in the first switching circuit. The drain lines DL coupled to the second red-displaying pixel PR2 and the nth re-displaying pixel PRn, respectively, in the first display block BK1 are connected to the second bus conductor BR2 and the nth bus conductor BRn of the drain bus via the second switch SR2 and the nth switch SRn, respectively. The drain line DL coupled to the (n+1)st red-displaying pixel PRn+1 in the second display block BK2 is connected to the first bus conductor BR1 of the drain bus via the (n+1)st switch SRn+1 in the second switching circuit. The drain line DL coupled to the 3nth red-displaying pixel PR3*n* in the third display block BK3 is connected to the nth bus conductor BRn of the drain bus via the 3nth switch SR3*n* in the third switching circuit.

On-or-off control of the n switches SR1, SR2, . . . , SRn included in the first switching circuit associated with the first display block BK1 is performed by a common signal Φ1, on-or-off control of the n switches SRn+1, SRn+2, . . . , SR2*n* included in the second switching circuit associated with the second display block BK2 is performed by a common signal Φ2, and on-or-off control of the n switches SR2*n*+1, SR2*n*+2, . . . , SR3*n* included in the third switching circuit associated with the third display block BK3 is performed by a common signal Φ3.

Although only the red-displaying pixels are shown in FIG. 4, the green-displaying pixels and the blue-displaying pixels are disposed in the first, second and third display blocks BK1, BK2, BK3 in the same manner as the red-displaying pixels, and there are the ith switch SGi associated with green-displaying pixels and the ith switch SBi associated with blue-displaying pixels disposed between the ith switch SRi and the (i+1)st switch SRi+1, where i is 1, 2, 3, . . . . In the case of the video signal bus also, the ith bus conductor BGi associated with green-displaying pixels and the ith bus conductor BBi associated with blue-displaying pixels are disposed between the ith bus conductor BRi and the (i+1)st bus conductor BRi+1.

In other words, each of the 3n drain lines DL in the first display block BK1 is coupled to a corresponding one of the 3n bus conductors of the drain bus via the first switching circuit composed of the 3n switches controlled in common by the signal Φ1, and each of the 3n drain lines DL in the second and third display blocks BK2, BK3 is connected to a corresponding one of the 3n bus conductors of the drain bus to which the first switching circuit is connected, via the second and third switching circuits each composed of the 3n switches controlled in common by the second and third signals Φ2, Φ3, respectively. Each of the 3n bus conductors of the drain bus which is connected to three corresponding drain lines DL in the first, second and third display blocks BK1, BK2, BK3 in common via the first, second and third switching circuits, respectively, is a corresponding one of 3n output terminals of the drain driver DRV. In this embodiment, the drain driver is fabricated on a semiconductor chip, and the semiconductor chip is attached to the display panel PNL.

The drain driver DRV includes an input latch I-LTC for receiving digital video data sequentially supplied from an external equipment, an output latch P-LTC for receiving the entire video data stored in the input latch I-LTC at a time and storing them, and digital-to-analog converters DAC for converting the video data stored in the output latch P-LTC to analog video signals and supplying the analog signals to corresponding ones of the pixels. This display device includes an external control circuit TCON for supplying the signals Φ1, Φ2, Φ3 to the first, second and third switching circuits on the display panel PNL, signals PLS for controlling the latches I-LTC, P-LTC within the drain driver DRV, and a reference voltage Vref to the digital-to-analog converters DAC within the drain driver DRV, and a delay device DLY for processing video data supplied from external equipment and supplying the processed video data to the drain driver DRV.

Video data in the same form as in the case of the first embodiment is input to the delay device DLY. The input video data are supplied in parallel to a first delay switch SW1 and a first delay circuit DL1. The video data supplied to the first delay circuit DL1 are delayed by a specified time and then are supplied in parallel to a second delay switch SW2 and a second delay circuit DL2. The delayed video data supplied to the second delay circuit DL2 are delayed by a specified time again, and are supplied to a third delay switch SW3. On-or-off controls of the first, second and third switches SW1, SW2, SW3 included in the delay device DLY are performed by signals ΦD1, ΦD2 and ΦD3, respectively, supplied from the external control circuit TCON.

The operation of the display device shown in FIG. 4 will be explained by reference to FIG. 5. Symbols I-R, I-G and I-B represent video data associated with red (R), green (G) and blue (B) signals supplied to the delay device DLY from external equipment. One plural-bit red video data I-R, one plural-bit green video data I-G and one plural-bit blue data I-B which constitute one picture dot are supplied in parallel to the delay device DLY at a time. Video data, each of which corresponds to one picture dot, equal in number to the number of picture dots coupled to one scanning line GL are supplied sequentially, and after a blanking time BLK following the completion of supply of video data corresponding to one scanning line GL, supply of video data corresponding to the next scanning line GL is started. Digital video data in the same form as in the case of the first embodiment are supplied to this display device from the external equipment.

Figure 5:
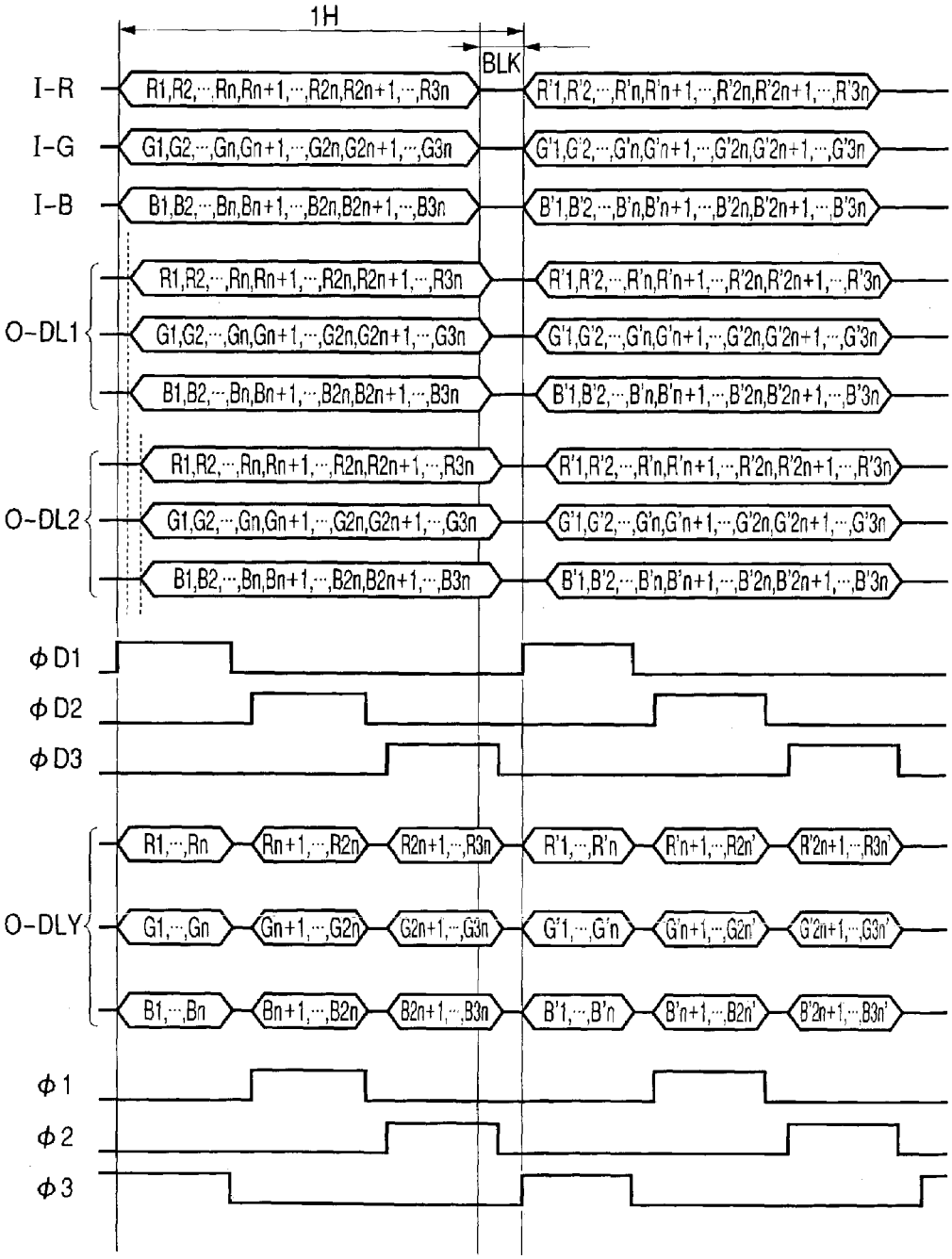
FIG. 5 is a timing chart for explaining the second embodiment of a display device in accordance with the present invention.

In FIG. 5, video data associated with a given one of the scanning lines GL are represented by (R1, G1, B1) for the first picture dot, (R2, G2, B2) for the second picture dot, . . . , (R3*n*, G3*n*, B3*n*) for the 3nth picture dot, and video data associated with one of the scanning lines GL succeeding the given scanning line GL are represented by (R'1, G'1, B'1) for the first picture dot, (R'2, G'2, B'2) for the second picture dot, . . . , (R'3*n*, G'3*n*, B'3*n*) for the 3nth picture dot.

At a time when supply of video data corresponding to one scanning line GL is started, that is, at a start time of one horizontal scanning period, the first delay switch SW1 controlled by the signal ΦD1 is in an ON state. This ON state is retained until video data associated with the nth picture dot are supplied. Therefore the supplied video data are supplied to the first delay circuit DL1, and at the same time pass through the first delay switch SW1, and are output to the drain driver DRV via output terminals O-DLY of the delay device DLY. The video data output to the drain driver DRV include video data for red-displaying pixels R1, R2, . . . , Rn, video data for green-displaying pixels G1, G2, . . . , Gn, and video data for blue-displaying pixels B1, B2, . . . , Bn.

The video data externally supplied to the first delay circuit DL1 are delayed therein by a specified time and then are output toward the second delay switch SW2 as indicated by a symbol O-DL1 in FIG. 4, and therefore, by turning the second delay switch SW2 into an ON state with the signal ΦD2 a specified time after the video data Rn, Gn and Bn associated with the nth picture dot have passed through the first delay switch SW1, video data associated with picture dots beginning with the (n+1)st picture dot are supplied to the drain driver DRV via the second delay switch SW2. A time interval between a time when the video data for the nth picture dot pass through the first delay switch SW1 and a time when the second delay switch SW2 is turned into the ON state needs to be made equal to the delay time by the first delay circuit DL1. As in the relationship between the signals ΦD1 and ΦD2 shown in FIG. 5, the first delay switch SW1 may be turned into the OFF state immediately after the video data associated with the nth picture dot has passed through the first delay switch SW1. Since the input latch I-LTC of the drain driver DRV does not have capacity sufficient for taking in video data corresponding to picture dots succeeding the nth picture dot, the first delay switch SW1 needs to be turned into the OFF state at least before the second delay switch SW2 is turned into the ON state.

The drain driver DRV transfers the video data corresponding to the first to nth picture dots taken sequentially into the input latch I-LTC via the first delay switch SW1 to the output latch P-LTC, before video data associated with the (n+1)st picture dot are input to the input latch I-LTC via the second delay switch SW2. Thereafter, the drain driver DRV takes video data associated with picture dots beginning with the (n+1)st picture dot sequentially into the input latch I-LTC via the second delay switch SW2, and at the same time converts the video date stored in the output latch P-LTC and corresponding to 3n picture dots including the first to nth picture dots to analog video signals to be supplied to pixels by using the digital-to-analog converters DAC, and then supplies the analog video signals to the drain bus.

On the other hand, in the display panel PNL, the first switching circuit is turned into an ON state by the signal Φ1 for controlling the 3n switches included in the first switching circuit about a time of rising of the signal ΦD2 for controlling the second delay switch SW2. Consequently, the video signals corresponding to the first to nth picture dots in the first display block BK1 supplied to the drain bus from the drain driver DRV are written into pixels selected by one of the scanning lines GL via the drain lines DL in the first display block BK1. During the period in which the video data are written into the pixels, the video data corresponding to the (n+1)st to 2nth picture dots from the first delay circuit DL1 are written sequentially into the input latch I-LTC within the drain driver DRV via the second delay switch SW2. Following the above, in the same manner as explained above, at a time when video data corresponding to the 2nth picture dot have passed through the second delay switch SW2, the first switching circuit of the display panel PNL is turned into the OFF state by the signal Φ1, and the video data corresponding to the (n+1)st to 2nth picture dots and stored in the input latch I-LTC of the drain driver DRV are transferred to the output latch P-ITC. After the first switching circuit is turned into the OFF state, the second switching circuit of the display panel PNL is turned into the ON state by the Φ2. With this operation, the video signals converted by the digital-to-analog converters DAC of the drain driver DRV and corresponding to the (n+1)st to 2nth picture dots are written into pixels in the second display block BK2. The pixels into which the video signals are written in the second display block BK2 are coupled to the scanning line GL having coupled thereto the pixels having the video data written into in the first display block BK1 immediately before.

The delay device DLY turns the third delay switch SW3 into the ON state by the signal ΦD3 a specified time after the video data corresponding to the 2nth picture dot has passed through the second delay switch SW2. The above specified time is equal to a delay time by which the second delay circuit DL2 delays the output from the first delay circuit DL1. With this operation, the third delay switch SW3 outputs to the drain driver DRV the video data corresponding to picture dots beginning with the (2n+1)st picture dot, among the video data output from the second delay circuit DL2. The drain driver DRV takes sequentially into the input latch I-LTC the video data which corresponds to picture dots beginning with the (n+1)st picture dot and are supplied via the third delay switch SW3. After the third delay switch SW3 has output video data corresponding to the 3nth picture dot, the video data stored in the input latch I-LTC of the drain driver DRV are transferred to the output latch P-LTC. Prior to this transfer of the video data, the second switching circuit of the display panel PNL is turned into the OFF state, and the third switching circuit is turned into the ON state by the signal Φ3. Thereafter, the delay device DLY repeats the same operation for the video data R'1, R'2, . . . , R'3*n*, G'1, G'2, . . . , G'3*n*, and B'1, B'2, . . . , B'3*n* corresponding to the next scanning line GL, and supplied from the external equipment.

It is desirable that the delay time of each of the first delay circuit DL1 and the second delay circuit DL2 is one third of a blanking time BLK included in the video data supplied from the external equipment. With this configuration, the drain driver DRV can use one third of the blanking time BLK in the external equipment as setup time, and consequently, timing control of the latches I-LTC, P-LTC and the digital-to-analog converters DAC becomes easier. Further, although it is necessary to delay the video data output from the external equipment by a time corresponding to n picture dots, selection of the scanning lines GL and control of the switching circuits of the display panel PNL become easier.

In the second embodiment, the display area DPA is divided into three display blocks, but the present invention is not limited to this configuration, and the display area DPA can be divided into plural display blocks which are 2, 4, 5, 6 or more in number.

Figure 6:
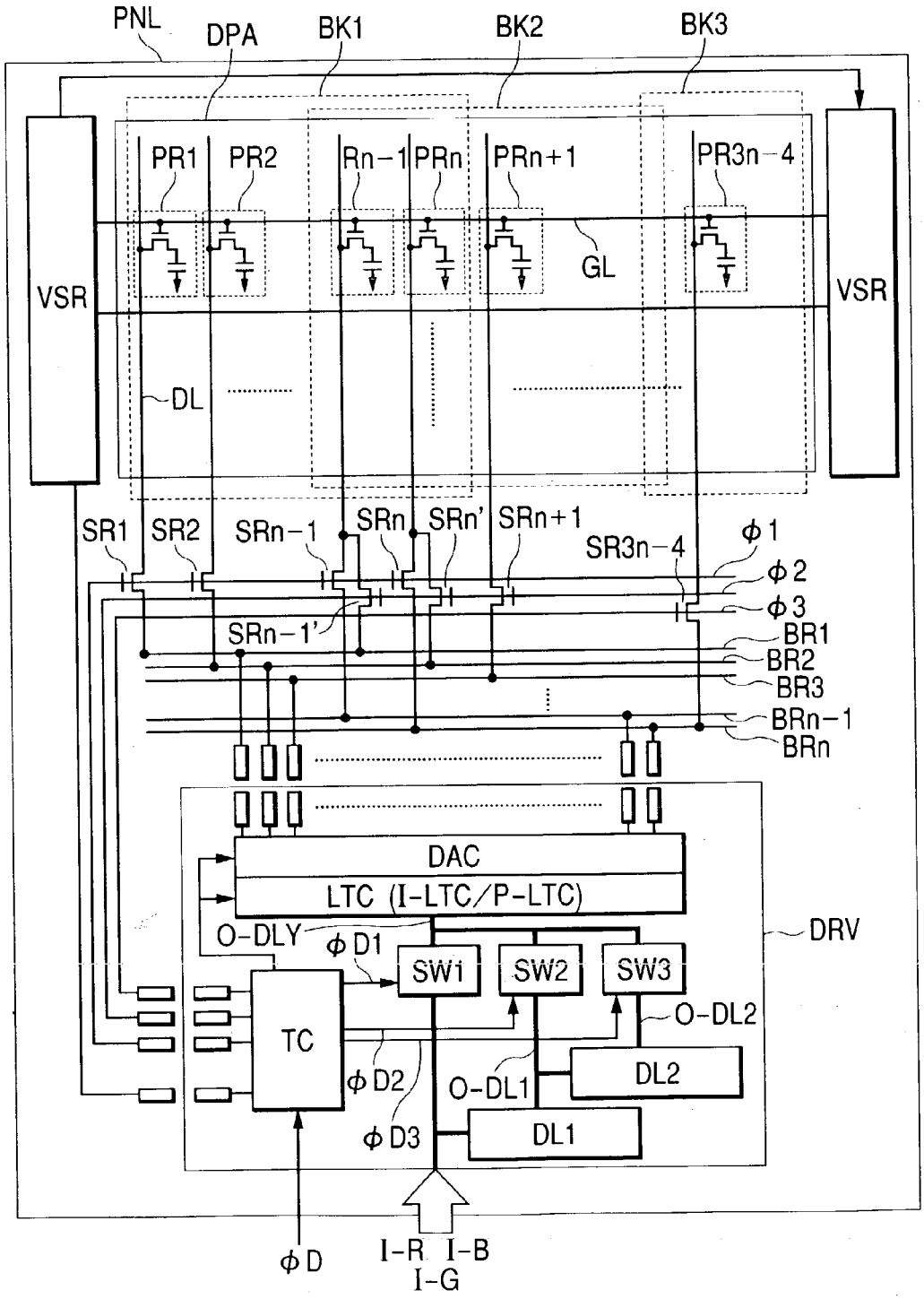
FIG. 6 is a circuit diagram for illustrating a second embodiment of a display device in accordance with the present invention.

FIG. 6 illustrates a third embodiment of a display device in accordance with the present invention. The display panel PNL of the display device of this embodiment is similar to that of the second embodiment, and the following explanation will be concentrated on the difference between this embodiment and the second embodiment. The display area DPA is composed of the first display block BK1, the second display block BK2, and the third display block BK3, each of which has n picture dots arranged in a direction of the scanning lines GL. In this display device, a portion of one display block overlaps on a portion of another display block, and therefore a portion of one switching circuit associated with one display block is shared by a portion of another switching circuit associated with another display block.

Specifically, an area corresponding to two picture dots is shared by the first display block BK1 and the second display block BK2, and therefore the pixels PRn−1 and PRn which belong to the first display block BK1 belong to the second display block BK2 also. A drain line DL coupled to the pixel PRn−1 is coupled to a bus conductor BRn−1 of a drain bus via a switch SRn−1 included in a first switching circuit, and also is coupled to a bus conductor BR1 of the drain bus via a switch SRn−1' included in a second switching circuit. A drain line DL coupled to the pixel PRn is coupled to a bus conductor BRn of the drain bus via a switch SRn included in the first switching circuit, and also is coupled to a bus conductor BR2 of the drain bus via a switch SRn' included in the second switching circuit. Although only the drain lines DL, the switches, and the bus conductors of the drain bus which are associated with red-displaying pixels are shown in FIG. 6, there are drain lines DL, switches, and bus conductors of the drain bus which are associated with green-displaying pixels and blue-displaying pixels, respectively, as in the case of the previous embodiments. 3n switches in the first switching circuit including the switches SRn−1 and SRn are controlled by the signal Φ1, and 3n switches in the second switching circuit including the switches SRn−1' and SRn' are controlled by the signal Φ2. Although omitted in FIG. 6, the second display block BK2 and the third display block BK3 also share an area corresponding to two picture dots, and therefore the second display block BK2 and the third display block BK3 have a configuration similar to the above-explained configuration.

In the display device shown in FIG. 6, (3n−4) picture dots are coupled to one scanning line GL, that is, 3(3n−4) pixels are coupled to one scanning line GL. Each of the display blocks is provided with 3n switches, and the bus conductors of the drain bus is 3n in number.

The 3n bus conductors of the drain bus are coupled to the drain driver DRV via 3n terminals disposed on the display panel PNL. The drain driver DRV is fabricated on one semiconductor chip, and the semiconductor chip is attached to the display panel PNL by using an anisotropic conductive sheet or the like and is supplied with digital video data from the external equipment. The supplied video data are transferred to input and output latch circuits I-LTC, P-LTC via two delay circuits DL1, DL2, and three delay switches SW1, SW2, SW3, then the digital video data stored in the input and output latch circuits I-LTC, P-LTC are converted to analog video signals by the digital-to-analog converters DAC, and then are supplied to the drain bus. The delay circuits DL1, DL2, the delay switches SW1, SW2, SW3, the latch circuits I-LTC, P-LTC, and the digital-to-analog converters DAC in this embodiment operate in a way similar to that explained in connection with the second embodiment.

Further, the drain driver DRV fabricated on one semiconductor chip contains a control circuit TC for outputting the signals for controlling the delay switches SW1, SW2, SW3, the latch circuits I-LTC, P-LTC, and the digital-to-analog converters DAC, the signals for controlling the first, second and third switching circuits of the display panel PNL, and the signals for controlling the drain driver DRV.

Non-uniformity of display between two display blocks can be suppressed by overlapping the display blocks as explained above, and the number of components constituting the display device can be reduced by incorporating the delay circuits into the drain driver DRV.

It is needless to say that the semiconductor chip can be disposed on a flexible circuit substrate, and can be coupled to the display panel PNL via the flexible circuit substrate. In this embodiment also, the display area DPA is divided into three display blocks, the display area DPA can be divided into two, four or more display blocks in consideration of characteristics of the drain driver DRV, characteristics of the switching circuits of the display panel PNL, cost, and others.

Further, plural trios of the first, second and third display blocks BK1, BK2, BK3 of this embodiment can be arranged laterally and repeatedly such that a large-sized display area can be obtained. In this case, if the delay circuits are fabricated on the semiconductor chip on which the drain driver DRV is fabricated, the complicated design of external delay circuits is eliminated and many kinds of display devices can be supplied at low cost, by providing one external delay device to a plurality of drain drivers DRV. Moreover, it is possible to establish from outside the semiconductor chip the delay times of the respective delay circuits, timings of the signals for controlling the delay switches and the signals for controlling the digital-to-analog converters and the latch circuits, and timing of the signals for controlling the switching circuits of the display panel PNL, to enhance the above beneficial effects. In this case, it is also possible to supply data for establishing of the above via the video data input terminals and the video signal output terminals of the drain drivers DRV, to process the data stored in a register formed of nonvolatile and volatile memories by using an internal processing circuit, and thereby to establish the above-mentioned delay times, timings and others. It is needless to say that the above-explained establishment of the delay times, timings and others can be applied to the delay device DLY and the drain driver DRV.

Figure 7:
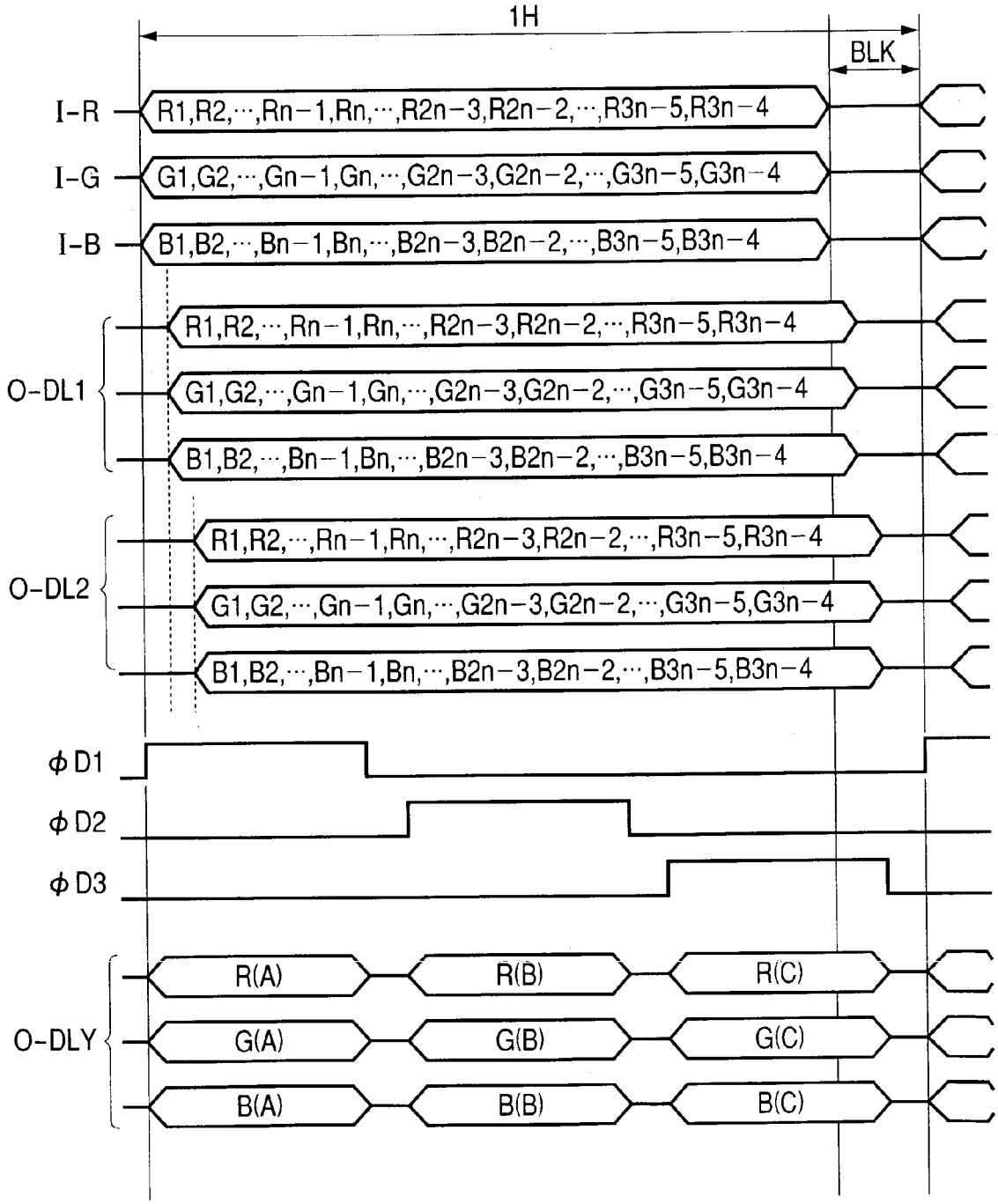
FIG. 7 is a timing chart for explaining the third embodiment of a display device in accordance with the present invention.

FIG. 7 illustrates the video data and signal waveforms at respective positions of the display device of this embodiment. In the embodiment of FIG. 6, some picture dots are shared by the adjacent display blocks, and therefore the video data and signal waveforms shown in FIG. 7 are somewhat different from those in the second embodiment. To keep always constant a time required for transferring video data from the input latch I-LTC to the output latch P-LTC within the drain driver DRV, that is, a setup time, it is desirable that a time interval between a time when last video data to be supplied to the input latch passes through a given delay switch and a time when the next delay switch is turned ON is equal to one third of the blanking time BLK in one horizontal scanning period. It is sufficient to select the delay time of the delay circuit to be a sum of one third of the blanking time BLK and a time equal to a product of a time required for external equipment to output video data corresponding to one picture dot and the number of picture dots shared by two display blocks.

In a case where the above display device is to be coupled to external equipment which supplies to a drain driver DRV, video data corresponding to two picture dots at a time, it is sufficient to provide two delay circuits to video data corresponding to two picture dots, respectively, within the delay device.

Figure 8:
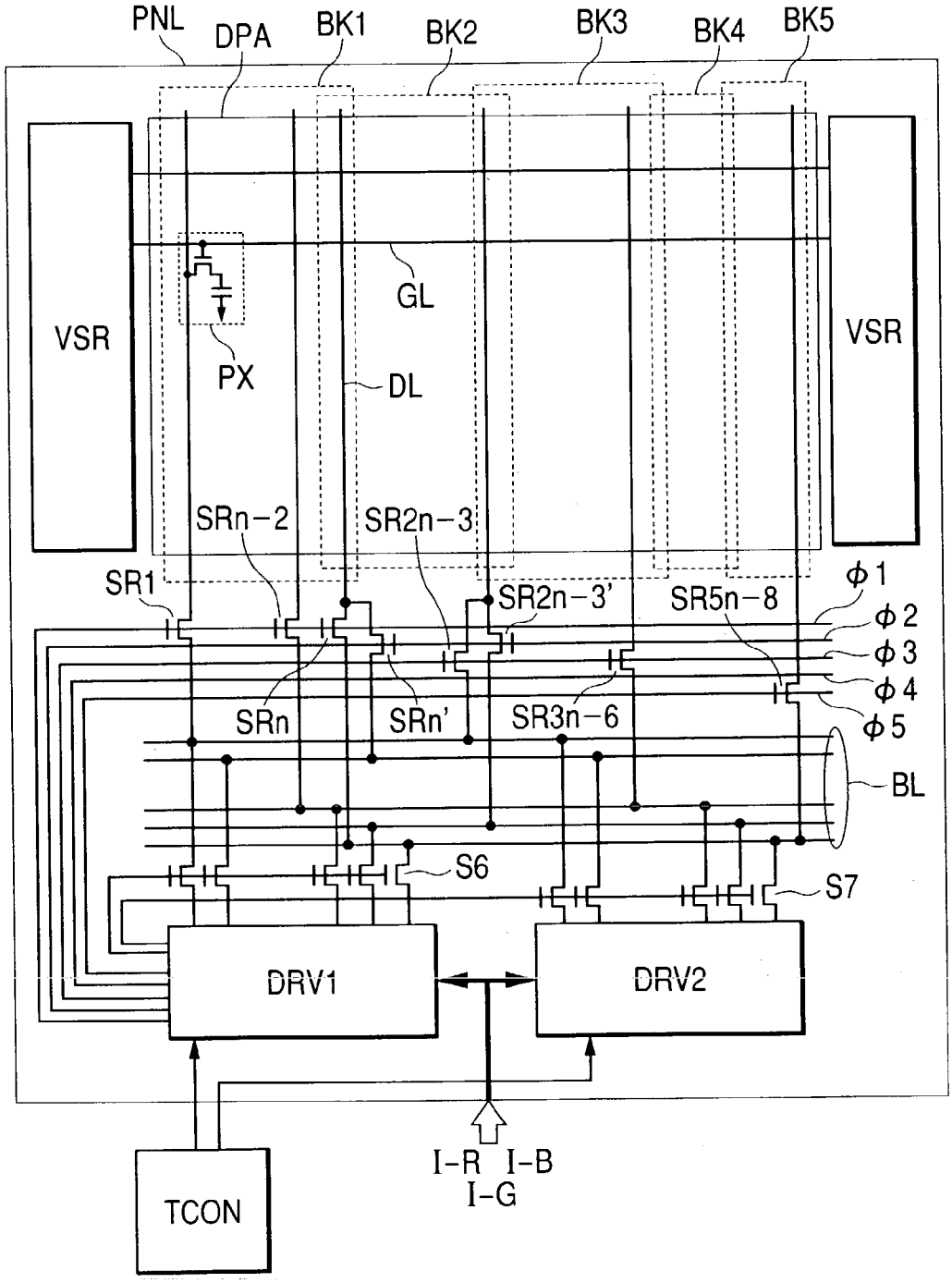
FIG. 8 is a circuit diagram for illustrating a fourth embodiment of a display device in accordance with the present invention.

FIG. 8 illustrates a fourth embodiment of a display device in accordance with the present invention. In this display device, the display area DPA is divided into five display blocks BK1 to BK5, and two picture dots are shared by two adjacent display blocks as in the case of the third embodiment. The drain lines in the respective display blocks are coupled to the drain bus BL via the respective switching circuits. On-or-off control of the respective switching circuits is performed by respective control signals.

Specifically, in the first display block BK1, n picture dots, that is, 3n pixels are coupled to one scanning line GL. In FIG. 8, only one pixel PX is shown. 3n-drain lines DL each coupled to a column of pixels in the first display block BK1 are connected to the switching circuit outside of the display area DPA. Each of the switching circuits includes 3n switches. For example, the first switching circuit includes switches SR1, SG1, SB1, SR2, SG2, SB2, . . . ., SRn, SGn, SBn, and 3n drain lines DL are connected to first terminals of the 3n switches SR1, SG1, SB1, SR2, SG2, SB2, . . . , SRn, SGn, SBn, respectively. As in the case of the previous embodiment, FIG. 8 shows only the drain lines DL coupled to the first, (n−2)nd, and nth red-displaying pixels and the switches SR1, SRn−2, and SRn coupled to the first, (n−2)nd, and nth red-displaying pixels, respectively. There are the drain lines DL coupled to green-displaying pixels and switches connected thereto SG1, SG2, . . . , SGn, and the drain lines DL coupled to blue-displaying pixels and switches connected thereto SB1, SB2, . . . , SBn, adjacently to the red-associated drain lines DL and the red-associated switches.

Second terminals of the 3n switches SR1, SG1, SB1, SR2, SG2, SB2, . . . , SRn, SGn, SBn included in the first switching circuit are connected to corresponding ones of 3n bus conductors of the drain bus BL, and on-or-off control of the 3n switches SR1, SG1, SB1, SR2, SG2, SB2, . . . , SRn−1, SGn−1, SBn−1, SRn, SGn, SBn is performed by the control signal Φ1.

In the second display block BK2, there are n picture dots including the (n−1)st to (2n−2)nd picture dots coupled to the above-mentioned scanning line GL, that is, 3n pixels. The 3n pixels are connected to first terminals of 3n switches SRn−1', SGn−1', SBn−1', SRn', SGn', SBn', SRn+1, SGn+1, SBn+1, SRn+2, SGn+2, SBn+2, . . . , SR2*n*−3, SG2*n*−3, SB2*n*−3, SR2*n*−2, SGn−2, SBn−2 included in the second switching circuit via the drain lines, respectively. Shown in FIG. 8 are only the drain lines DL coupled to the nth and (2n−3)rd red-displaying pixels, and switches SRn' and SR2*n*−3 connected the two drain lines DL, respectively. The second terminals of the 3n switches included in the second switching circuit are connected to corresponding ones of the 3n bus conductors of the drain bus BL, as in the case of the 3n switches included in the first switching circuit. On-or-off control of the 3n switches in the second switching circuit is performed by the control signal Φ2. The first display block BK1 and the second display block BK2 share two picture dots, that is, six pixels, and therefore, as in the previous embodiment, the shared two picture dots, that is, the six pixels including the (n−1)st and nth pixels for each color, are coupled to a first group of bus conductors in the drain bus BL via the switches SRn−1, SGn−1, SBn−1, SRn, SGn, SBn included in the first switching circuit, and also are coupled to a second group of bus conductors in the drain bus BL via the switches SRn−1', SGn−1', SBn−1', SRn', SGn', SBn' included in the second switching circuit. Also in the third display block BK3, the fourth display block BK4, and the fifth display block BK5, the above-explained configuration is provided repeatedly.

The third switching circuit associated with the third display block BK3, including switches SR2*n*−3', SG2*n*−3', SB2*n*−3', SR2*n*−2', SGn−2', SBn−2', SR2*n*−1, SG2*n*−1, SB2*n*−1, SR2*n*, SG2*n*, SB2*n*, . . . , SR3*n*−5, SG3*n*−5, SB3*n*−5, SR3*n*−4, SG3*n*−4, SB3*n*−4, are controlled by the signal Φ3. The fourth switching circuit associated with the fourth display block BK4, including switches SR3*n*−5', SG3*n*−5', SB3*n*−5', SR3*n*−4', SG3*n*−4', SB3*n*−4', SR3*n*−3, SG3*n*−3, SB3*n*−3, SR3*n*−2, SG3*n*−2, SB3*n*−2, . . . , SR4*n*−7, SG4*n*−7, SB4*n*−7, SR4*n*−6, SG4*n*−6, SB4*n*−6, are controlled by the signal Φ4. The fifth switching circuit associated with the fifth display block BK5, including switches SR4*n*−7', SG4*n*−7', SB4*n*−7', SR4*n*−6', SG4*n*−6', SB4*n*−6', SR4*n*−5, SG4*n*−5, SB4*n*−5, SR4*n*−4, SG4*n*−4, SB4*n*−4, . . . ., SR5*n*−9, SG5*n*−9, SB5*n*−9, SR5*n*−8, SG5*n*−8, SB5*n*−8, are controlled by the signal Φ5.

In this embodiment, the picture dots coupled to one scanning line GL of the display panel PNL are 5n−8 in number, and therefore the pixels coupled to one scanning line GL are 3(5n−8) in number.

Each of the bus conductors constituting the drain bus BL is connected to a first drain switch S6 and a second drain switch S7 in parallel, and is coupled to a first drain driver DRV1 via the first drain switch S6 and also is connected to a second drain driver DRV2 via the second drain switch S7. In this embodiment, the two drain drivers DRV1, DRV2 are attached directly to the display panel PNL, but the present invention is not limited to this configuration, and the two drain drivers DRV1, DRV2 can be coupled to the display panel via a flexible wiring board, and the two drain drivers DRV1, DRV2 can be formed directly on the substrate by using a low-temperature polysilicon technique or the like.

The two drain drivers DRV1 and DRV2 are supplied with digital video data I-R, I-G, and I-B, in parallel. The first drain driver DRV1 supplies signals for gate drivers VSR which drive the scanning lines GL, and control signals for controlling the switching circuits including the switches SR1, SG1, SB1, . . . , SR5*n*−8, SG5*n*−8, SB5*n*−8 associated with the display blocks BK1, . . . , BK5, and for controlling the drain switches S6, S7. The external control circuit TCON is provided for the purpose of supplying signals which control the drain drivers DRV1, DRV2, but the present invention is not limited to this configuration, and the external control circuit TCON can be configured to supply the signals for controlling the gate drivers VSR, the switching circuits including the switches SR1, SG1, SB1, . . . , SR5*n*−8, SG5*n*−8, SB5*n*−8, and the drain switches S6, S7.

Further, this embodiment can be modified as follows.

The external control circuit TCON supplies the signals for controlling the drain switches S6, S7, the first drain driver DRV1 supplies the signals for controlling the first switching circuit including the switches SR1, SG1, SG1, . . . , SRn, SGn, SBn, the third switching circuit including the switches SR2*n*−3', SG2*n*−3', SB2*n*−3', . . . , SR3*n*−4, SG3*n*−4, SB3*n*−4, and the fifth switching circuit SR4*n*−7', SG4*n*−7', SB4*n*−7', . . . , SR5*n*−8, SG5*n*−8, SB5*n*−8, and the second drain driver DRV2 supplies the signals for controlling the second switching circuit including the switches SRn−1', SGn−1', SGn−1', . . . , SR2*n*−2, SG2*n*−2, SB2*n*−2, and the fourth switching circuit including the switches SR3*n*−5', SG3*n*−5', SB3*n*−5', . . . , SR4*n*−6, SG4*n*−6, SB4*n*−6.

Figure 9:
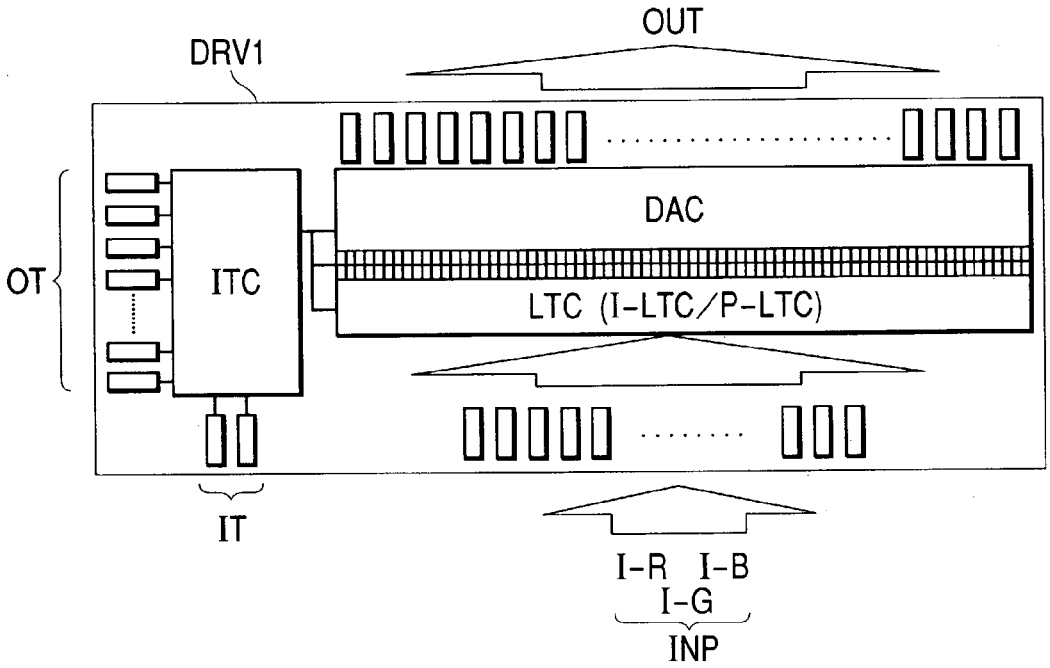
FIG. 9 is a block diagram for illustrating a drain driver in the fourth embodiment of a display device in accordance with the present invention.

FIG. 9 illustrates details of the first drain driver DRV1 shown in FIG. 8. In this embodiment, the drain driver DRV1 is fabricated on one semiconductor chip. The first drain driver DRV1 is supplied with video data corresponding to one picture dot at a time. As in the previous embodiment, each of the video data corresponding to red (R), green (G) and blue (B) signals are in plural-bit digital form. At the same time the video data are also supplied in parallel to the second drain driver DRV2 shown in FIG. 8. The video data I-R, I-G and I-B supplied via terminals from the external equipment are input into the input latch I-LTC within the latch LTC. The video data stored in the input latch I-LTC are transferred to the output latch P-LTC within the latch LTC based upon a signal supplied from an internal control circuit ITC within the drain driver DRV1, then the digital video data from the output latch P-LTC are converted to analog signals by the digital-to-analog converters DAC, and then the analog signals are supplied to the display panel PNL via external terminals.

The internal control circuit ITC outputs signals for controlling timings of transfer of the video data of the latch LTC and the outputs of the digital-to-analog converters DAC, based upon the signals input via control signal input terminals IT from the external control circuit TCON of FIG. 8. The internal control circuit ITC outputs the signals for controlling the gate drivers VSR of the display panel PNL, the switching circuits including the switches SR1, SG1, SB1, . . . , SR5*n*−8, SG5*n*−8, SB5*n*−8, and the drain switches S6, S7 via control signal output terminals OT. In FIG. 9, a reference voltage is omitted which the digital-to-analog converters DAC uses for producing analog video signals.

Figure 10:
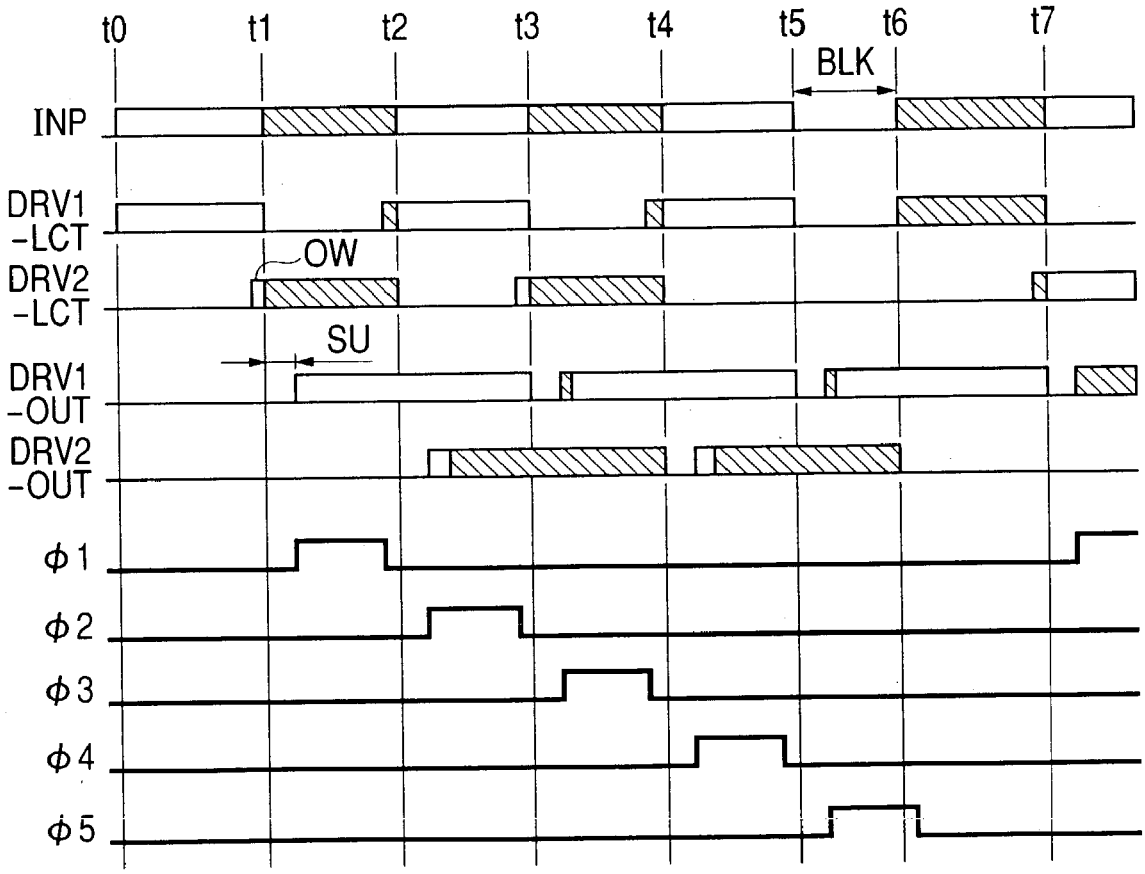
FIG. 10 is a timing chart for explaining the fourth embodiment of a display device in accordance with the present invention.

FIG. 10 illustrates timings of the signals and data in the fourth embodiment explained in connection with FIGS. 8 and 9. The two drain drivers DRV1 and DRV2 are supplied with video data corresponding to one picture dot comprising one red-displaying pixel, one green-displaying pixel and one blue-displaying pixel in parallel at a time from the external equipment, as in the previous embodiments. INP in FIG. 10 represents the video data supplied from the external equipment.

Video data corresponding to the first to nth picture dots associated with one scanning line GL which correspond to the first display block BK1 are input during a time interval from t=t0 to t=t1, then video data corresponding to picture dots up to the (2n−2)nd picture dot which correspond the second display block BK2 are input by a time t=t2, then video data corresponding to picture dots up to the (3n−4)th picture dot which correspond the third display block BK3 are input by a time t=t3, then video data corresponding to picture dots up to the (4n−6)th picture dot which correspond the fourth display block BK4 are input by a time t=t4, then video data corresponding to picture dots up to the (5n−8)th picture dot which correspond the fifth display block BK5 are input by a time t=t5. Then, after a blanking time BLK from t=t5 to t=t6, at a time=t6, inputting of video data corresponding to the scanning line GL starts.

The first drain driver DRV1 takes the video data supplied during the time t=t1 to t=t1 into the input latch I-LTC within the first drain driver DRV1, that is, takes in the video data corresponding to 3n pixels associated with the first to nth picture dots which correspond to the first display block BK1.

The second drain driver DRV2 starts to operate shortly before the time t1, and takes the video data corresponding to the (n−1)st to (2n−2)nd picture dots which corresponds to the second display block BK2 supplied from the external equipment, into the input latch I-LTC. The first drain driver DRV1 takes in the video data corresponding to the nth picture dot at the time t1, and thereafter transfers the video data stored in the input latch I-LTC to the output latch P-LTC. The video data transferred to the output latch P-LTC are converted to analog signals by the digital-to-analog converters DAC, and the analog signals are supplied to output terminals of the drain driver DRV1. Symbol SU in FIG. 10 denotes a time required for completing the transfer of the video data from the input latch I-LTC to the output latch P-LTC, and the subsequent digital-to-analog conversion of the video data.

The first drain switch S6 and the first switching circuit including the switches SR1, SG1, SB1, . . . , SRn, SGn, SBn and controlled by the signal Φ1, of the display panel PNL are turned ON, in synchronism with the outputting of the video signals associated with 3n pixels corresponding to the first to nth picture dots which correspond to the first display block BK1, from the first drain driver DRV1. Consequently, the video signals corresponding to the 3n pixels from the first drain driver DRV1 are supplied to the 3n drain lines in the first display block BK1, respectively, and are written into the corresponding pixels, via the first drain switch S6, the drain bus BL, and the first switching circuit.

The video data corresponding to picture dots up to the (2n−2)nd picture dots are written into the input latch I-LTC of the second drain driver DRV2. After the video data corresponding to the n picture dots have been into the input latch I-LTC of the second drain driver DRV2, at the time t2 the video data stored in the I-LTC of the second drain driver DRV2 are transferred to the output latch P-LTC of the second drain driver DRV2, and then the video data stored in the output latch P-LTC are converted to analog video signals by the digital-to-analog converters DAC. At a setup time after the time t2, the analog video signals produced by the second drain driver DRV2 are output as DRV2-OUT of the second drain driver DRV2 as indicated in FIG. 10, and it is necessary to turn OFF the first switching circuit including the switches SR1, SG1, SB1, . . . , SRn, SGn, SBn and the first drain switch S6 prior to the outputting of the DRV2-OUT.

In synchronism with the outputting of the video signals corresponding to the second display block BK2 from the second drain driver DRV2 at the setup time after the time t2, the outputs of the second drain driver DRV2 are written into pixels of the second display block BK2 by turning ON the second drain switch S7 and the second switching circuit including the switches SRn−1', SGn−1', SBn−1', . . . , SR2*n*−2, SG2*n*−2, SB2*n*−2.

Further, shortly before the time t2, the first drain driver DRV1 starts to operate again, the first drain driver DRV1 takes video data corresponding to picture dots beginning with the (2n−3)rd picture dot which correspond to the third display block BK3 into the input latch I-LTC. In this way, the above-explained operation is repeated for the third, fourth and fifth display blocks BK3, BK4, BK5, and then after the blanking time BLK, the above-explained operation is repeated for video data corresponding to the next scanning line GL.

In this way, video data corresponding to (5n−8) picture dots associated with one scanning line Gl and supplied from the external equipment are written into pixels in the first to fifth display blocks BK1, . . . , BK5 by alternately operating each of the first and second drain drivers DRV1 and DRV2.

In this embodiment, two picture dots are shared by the two adjacent display blocks BK1, BK2, and shortly before the time t1, the second drain driver DRV2 starts to take video data into the input latch I-LTC of the second drain driver DRV2. Timing of starting of operation of the second drain driver DRV2 can be determined based upon the number of picture dots shared by two adjacent display blocks. In the above explanation, during a time in which the video data is written in pixels of the first to fifth display blocks BK1 to BK5, a corresponding one of the scanning line GL retains the selected state.

In this embodiment, operation of the drain switches S6, S7 is explained as synchronized with operation of the switching circuits including the switches SR1, SG1, SB1, . . . , SR5*n*−8, SG5*n*−8, SB5*n*−8 coupled between the drain lines DL and the bus BL, but the present invention is not limited to this configuration.

In order to charge the drain bus BL to potentials of video signals sufficiently, it is possible to make a time when the drain switches S6, S7 are turned ON earlier than a time when the switching circuits including the switches SR1, SG1, SB1, . . . , SR5*n*−8, SG5*n*−8, SB5*n*−8 are turned ON. It is also possible to make a time when the switching circuit including the switches SR1, SG1, SB1, . . . , SR5*n*−8, SG5*n*−8, SB5*n*−8 are turned OFF later than a time when the drain switches S6, S7 are turned OFF.

Further, it is possible to implement a precharge circuit for short-circuiting between bus conductors constituting the drain bus BL during a time when the switching circuits including the switches SR1, SG1, SB1, . . . , SR5*n*−8, SG5*n*−8, SB5*n*−8 and the drain switches S6, S7 are turned OFF. This configuration makes it possible to move the potential of each of the bus conductors of the drain bus BL at approximately the center of a gray-scale voltage, and consequently, this makes possible high-speed writing of subsequent video signals.

When the display device is driven in a dot-inversion fashion, it is possible to implement a precharge circuit configured to short-circuit odd-numbered bus conductors and even-numbered bus conductors of the drain bus BL, separately.

In this embodiment, the drain switches S6, S7 are provided to separate one of the two drain drivers DRV1, DRV2 from the drain bus BL during a time when the other of the two drain drivers DRV1, DRV2 is operating, but to simplify the structure on the display panel PNL, the two drain drivers DRV1, DRV2 can be connected directly to the drain bus BL without implementing the drain switches S6, S7, but in this case the two drain drivers DRV1, DRV2 need to be controlled such that video signals are not output from the digital-to-analog converters DAC within the drain driver which does not output video signals to be written into pixels.

At all times in the embodiment, video signals to be written into the first, third, and fifth display blocks BK1, BK3, BK5 are produced by the first drain driver DRV1, and video signals to be written into the second and fourth display blocks BK2, BK4 are produced by the second drain driver DRV2, and however, to equalize the loads of the first and second drain drivers DRV1, DRV2, the configuration can be modified such that the order of operations of the first and second drain drivers DRV1, DRV2 is reversed on successive scanning lines GL. It is needless to say that the number of the display blocks is not limited to five, and can be selected to other odd or even numbers without departing from the spirit and scope of the present invention.

Further, the switching circuit (SR4*n*−7, SG4*n*−7, SB4*n*−7, . . . , SR5*n*−8, SG5*n*−8, SB5*n*−8 in this embodiment) associated with the display block disposed at the extreme right (the fifth display block BK5 in this embodiment) can be eliminated by adjusting of timing for turning the scanning lines GL into the OFF state.

Figure 11:
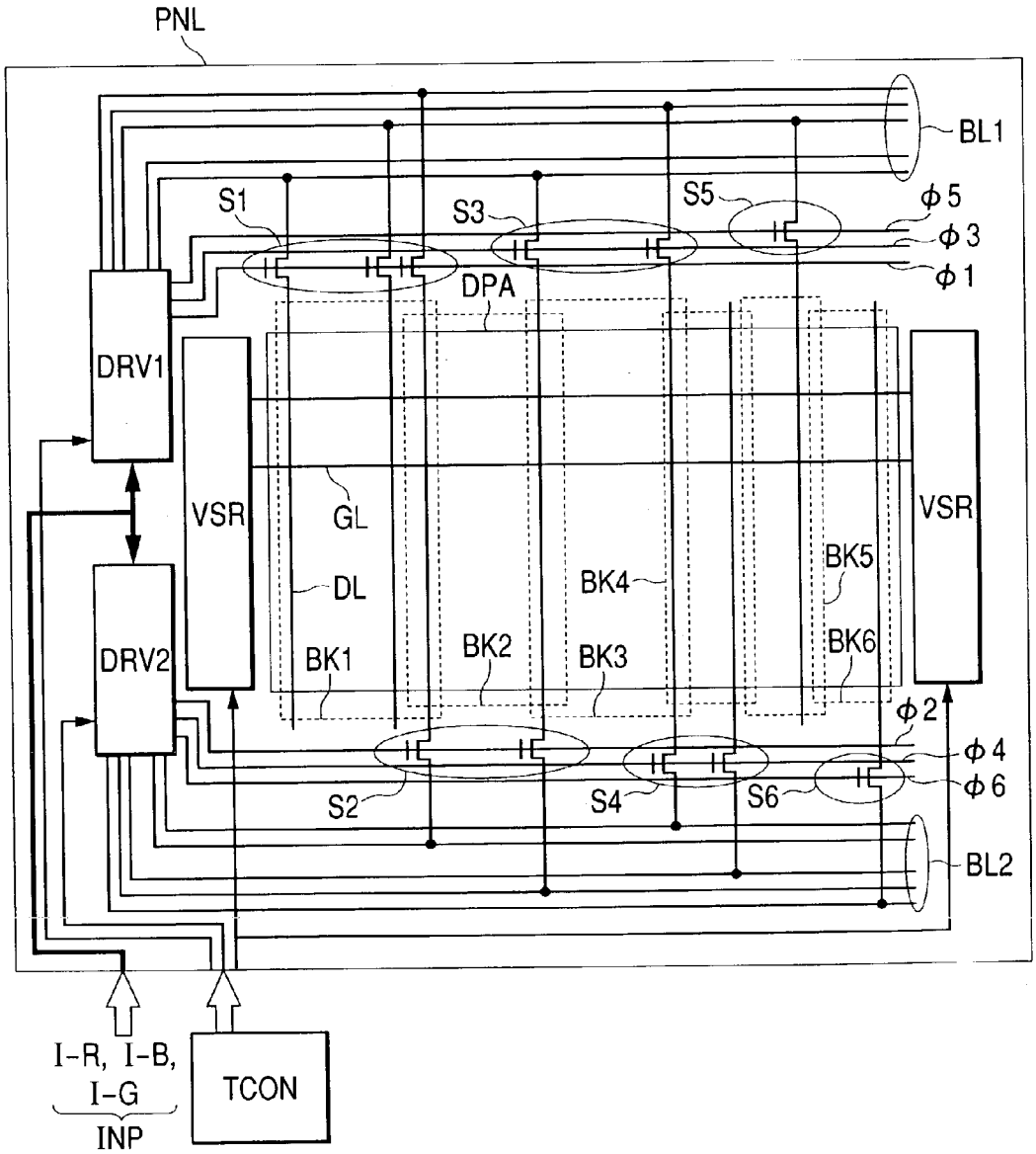
FIG. 11 is a circuit diagram for illustrating a fifth embodiment of a display device in accordance with the present invention.

FIG. 11 illustrates a fifth embodiment of a display device in accordance with the present invention. In this display device, the display area DPA is divided into five display blocks BK1 to BK6.

A plurality of drain lines DL in the first display block BK1 are coupled to a first drain bus BL1 disposed at the top of the display panel PNL via a first switching circuit S1 disposed at the top of the display panel PNL. Further, drain lines DL in the third display block BK1 and the fifth display block BK5 are coupled to the first drain bus BL1 via a third switching circuit S3 and a fifth switching circuit S5 disposed at the top of the display panel PNL, respectively.

Further, drain lines DL in the second display block BK2, the fourth display block BK4, and the sixth display block BK6 are coupled to a second drain bus BL2 disposed at the bottom of the display panel PNL via a second switching circuit S2, a fourth switching circuit S4, and a sixth switching circuit S6 disposed at the bottom of the display panel PNL, respectively.

The first drain bus BL1 is connected to a first drain driver DRV1 disposed at a side of the display panel PNL, and the second drain bus BL2 is also connected to a second drain driver DRV2 disposed at the side of the display panel PNL. The first DRV1 and second drain drivers DRV2 are supplied with video data in digital form from outside of the display device.

In this embodiment also, some picture dots are shared by two adjacent display blocks, drain lines associated with the shared picture dots are coupled to the first drain bus BL1 via switches included in one of the switching circuits disposed at the top of the display panel PNL, and also are coupled to the second drain bus BL2 via switches included in one of the switching circuits disposed at the bottom of the display panel PNL.

Specifically, drain lines associated with the picture dots shared by the first display block BK1 and the second display block BK2 are coupled to the first drain bus BL1 via switches included in the first switching circuit S1, and also are coupled to the second drain bus BL2 via switches included in the second switching circuit S2. On-or-off control of the plural switches included in the first switching circuit at the top of the display panel PNL is performed by a signal Φ1 from the first drain driver DRV1. The third switching circuit S3 and the fifth switching circuit S5 are controlled by signals Φ3 and Φ5 from the first drain driver DRV1, respectively. On-or-off control of the second switching circuit S2, the fourth switching circuit 4, and the sixth switching circuit S6 at the bottom of the display panel PNL is performed by signals Φ2, Φ4, and Φ6 from the second drain driver DRV2, respectively. The third switching circuit S3 and the fifth switching circuit S5 are controlled by signals Φ3 and Φ5 from the first drain driver DRV1, respectively. Signals for controlling the two drain drivers DRV1, DRV2, and signals for controlling gate drivers VSR driving the scanning lines GL formed in the display area DPA are supplied from an external control circuit TCON external to the display panel PNL.

In this embodiment, n picture dots are coupled to each of the scanning lines GL in each of the display blocks, and therefore (6n−10) picture dots, that is, 3(6n−10) pixels, are coupled to each of the scanning lines GL over the entire area of the display panel PNL. Therefore the drain lines DL are 3n in number in each of the display blocks, and each of the two drain buses BL1, BL2 at the top and the bottom of the display panel PNL has 3n bus conductors.

However, by making the first and second drain drivers DRV1, DRV2 unequal in driving capability, the number of the drain lines DL in each of the first, third and fifth display blocks BK1, BK3, BK5 can be selected to be unequal to the number of the drain lines DL in each of the second, fourth, and sixth display blocks BK2, BK4, BK6. This configuration makes it possible to increase an area occupied by one of the drain buses BL1, BL2 at the top and bottom of the display panel PNL, and reduce an area occupied by the other of the drain buses BL1, BL2.

In this embodiment, the signals for controlling the first, third and fifth switching circuits S1, S3, S5 and the signals for controlling the second, fourth and sixth switching circuits S2, S4, S6 are supplied from the drain driver DRV1 and the drain driver DRV2, respectively, but this configuration can be modified such that only one of the two drain drivers DRV1, DRV2 supplies all of the signals, or such that an external control circuit TCON controls the switching circuits.

In this embodiment, two drain buses BL1, BL2 are disposed at the top and bottom of the display panel PNL, respectively, but both the two drain buses BL1, BL2 can be disposed in parallel with each other at one of the top and bottom of the display panel PNL.

It is needless to say that the number of the display blocks are not limited to six, but the display area DPA can be divided into an even or odd number greater other than 6. Further, two configurations of this embodiment can be arranged laterally and four drain buses and four drain drivers DRV can be employed for this modification.

Figure 12:
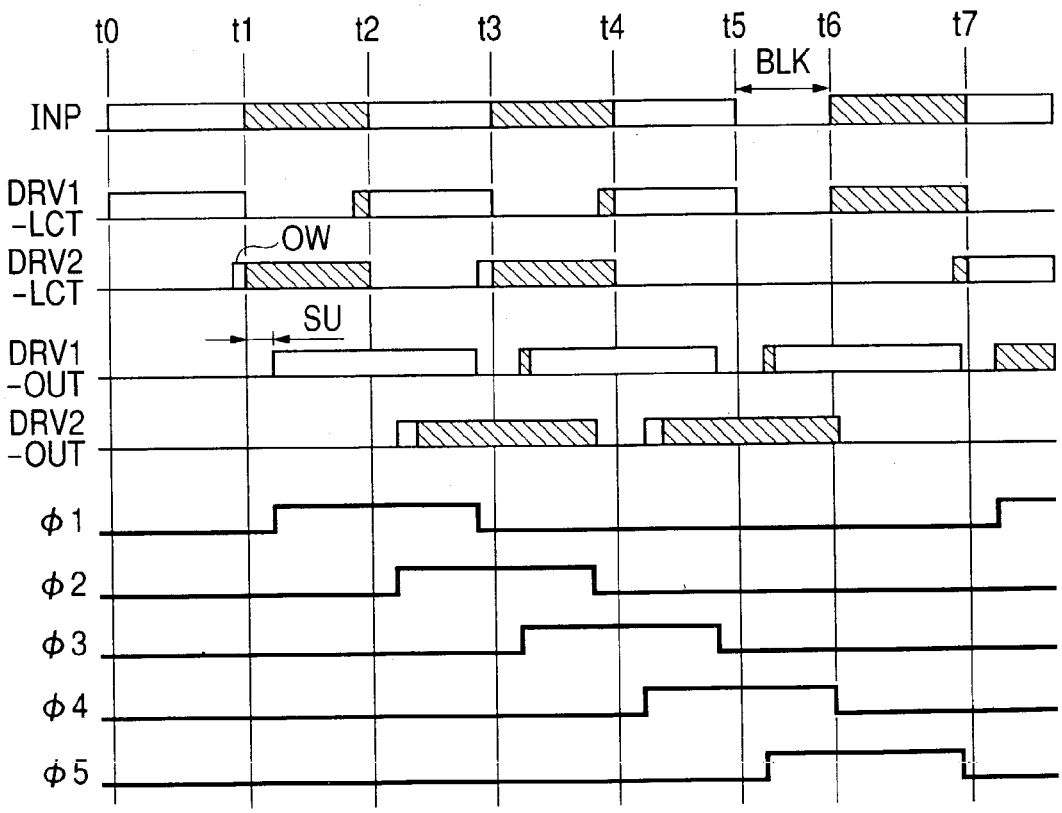
FIG. 12 is a timing chart for explaining the fifth embodiment of a display device in accordance with the present invention.
Figure 13:
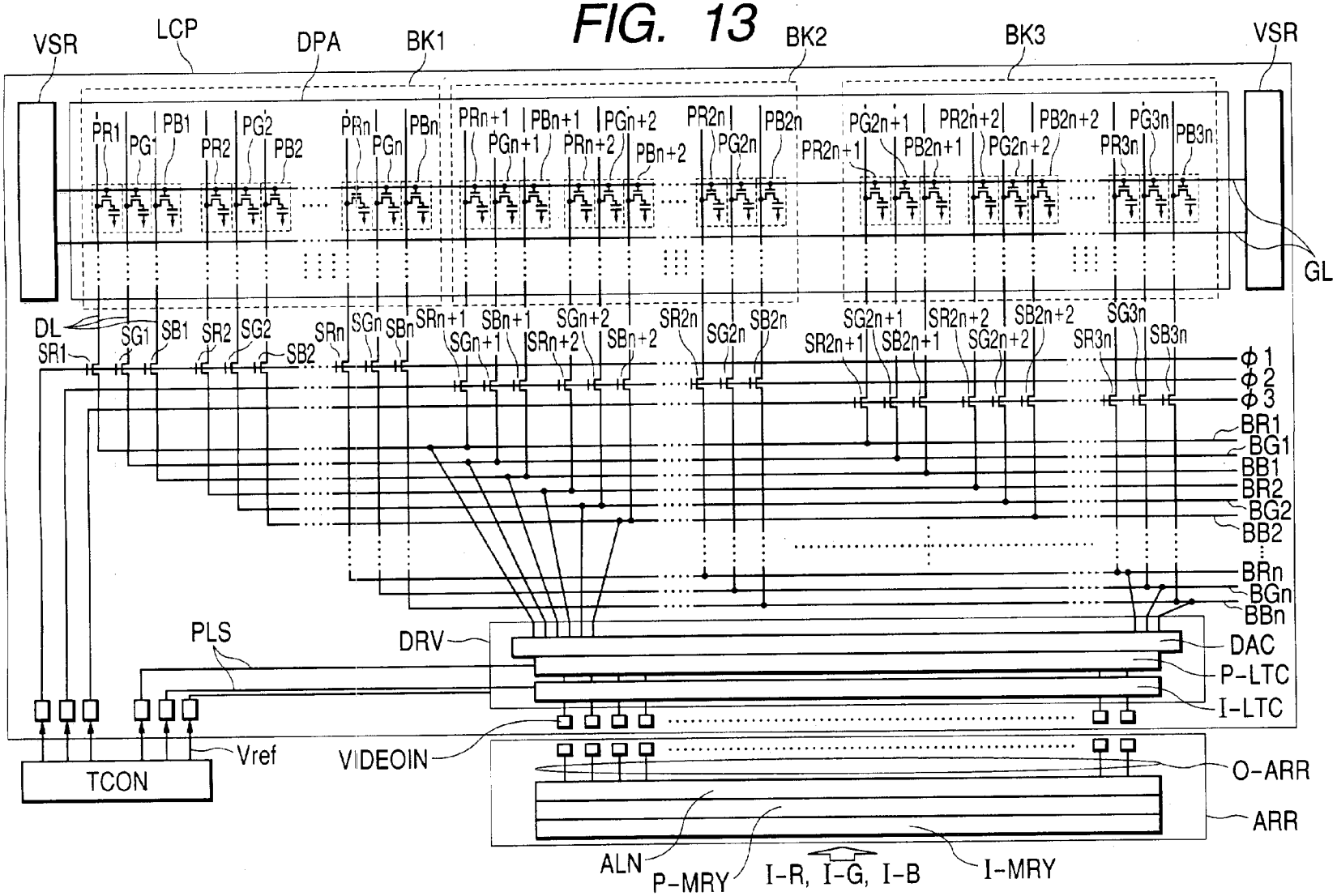
FIG. 13 is a circuit diagram for illustrating a second conventional display device.
Figure 14:
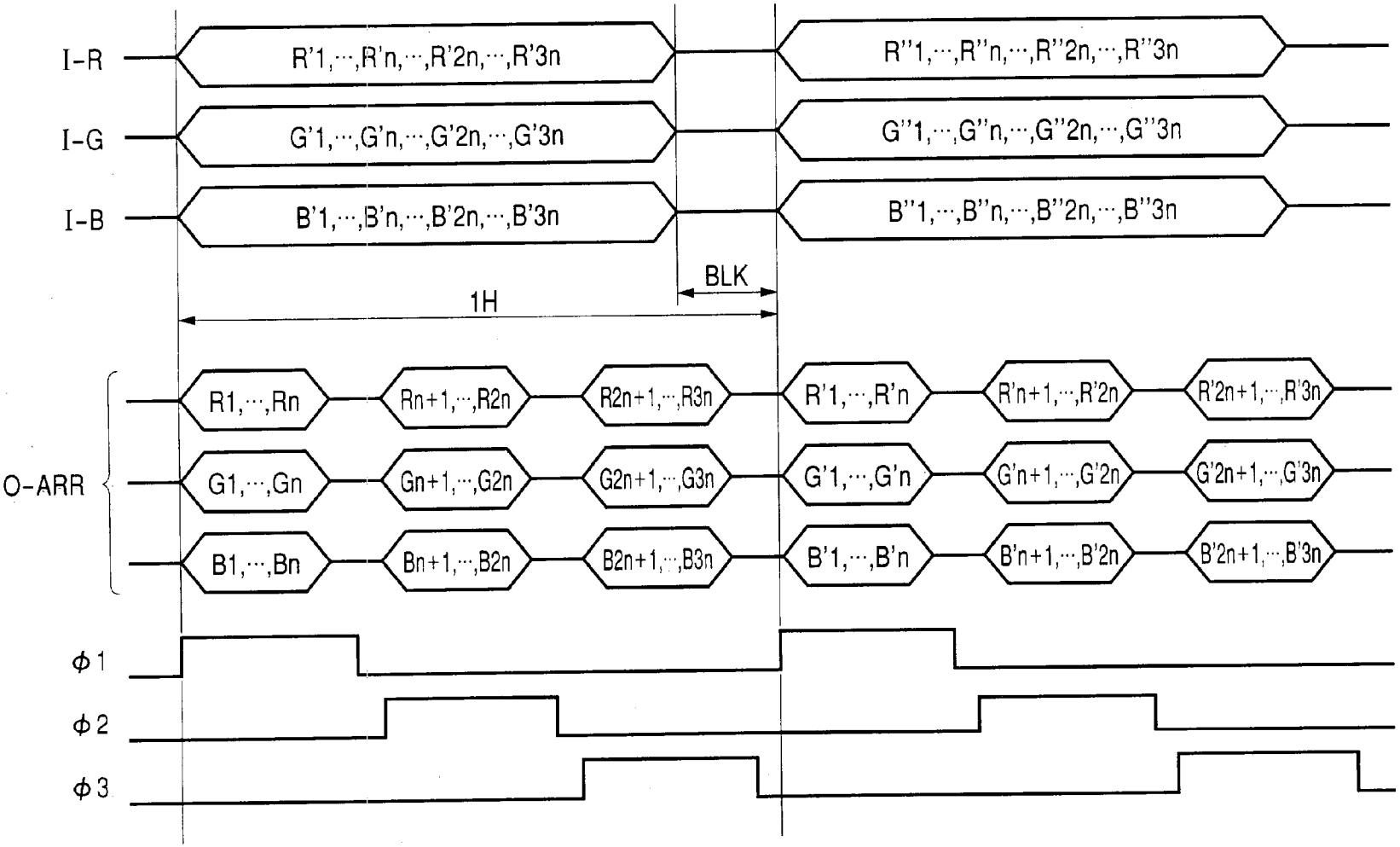
FIG. 14 is a timing chart for explaining the second conventional display device.
Figure 15:
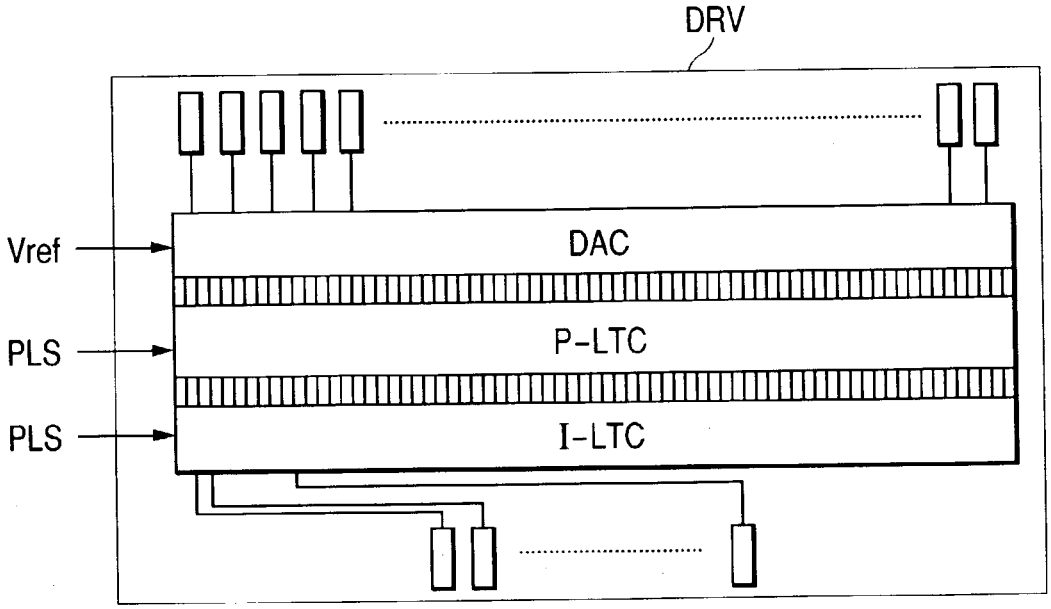
FIG. 15 is a block diagram for illustrating a conventional drain driver chart.
Figure 16:
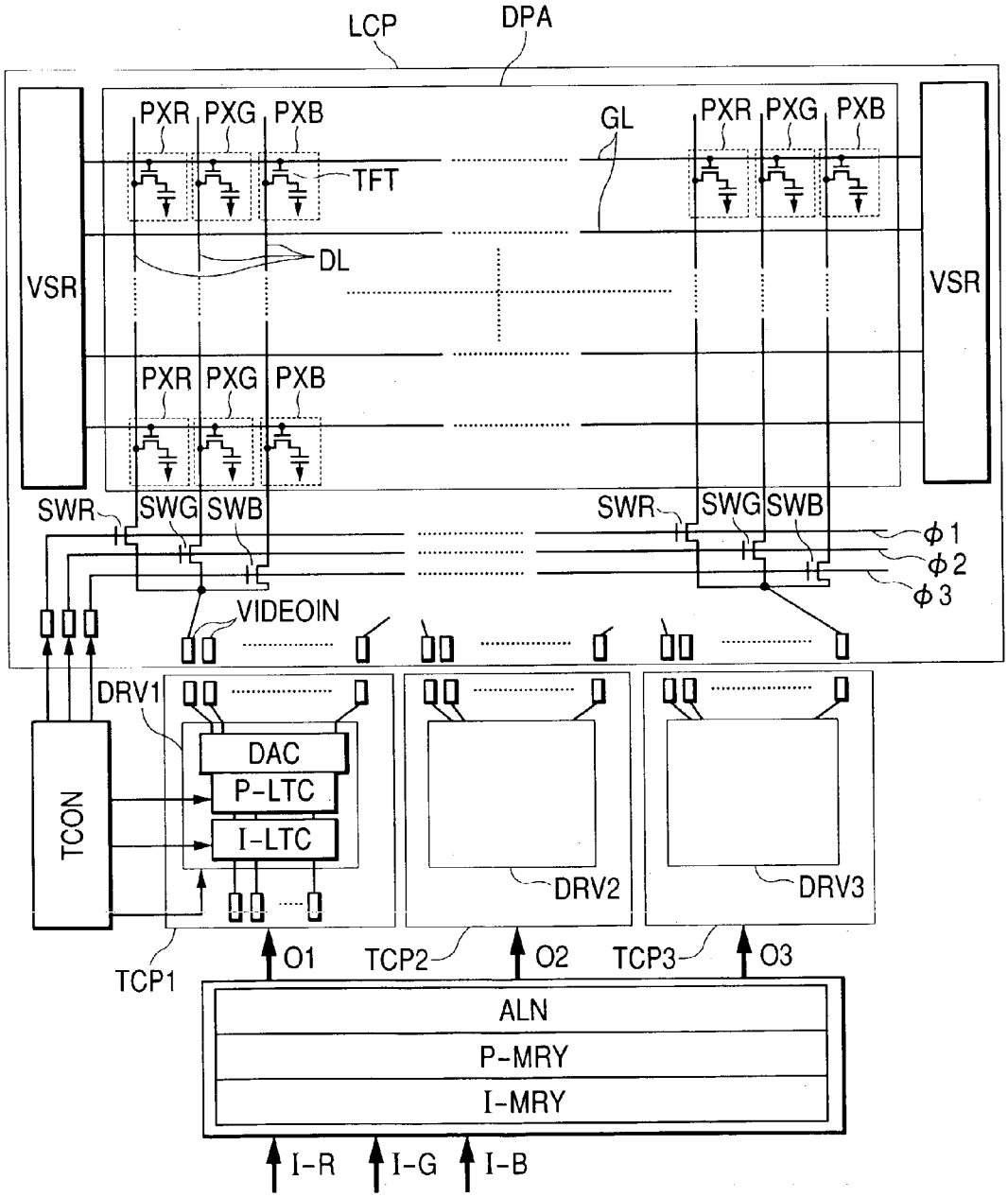
FIG. 16 is a circuit diagram for illustrating a first conventional display device.
Figure 17:
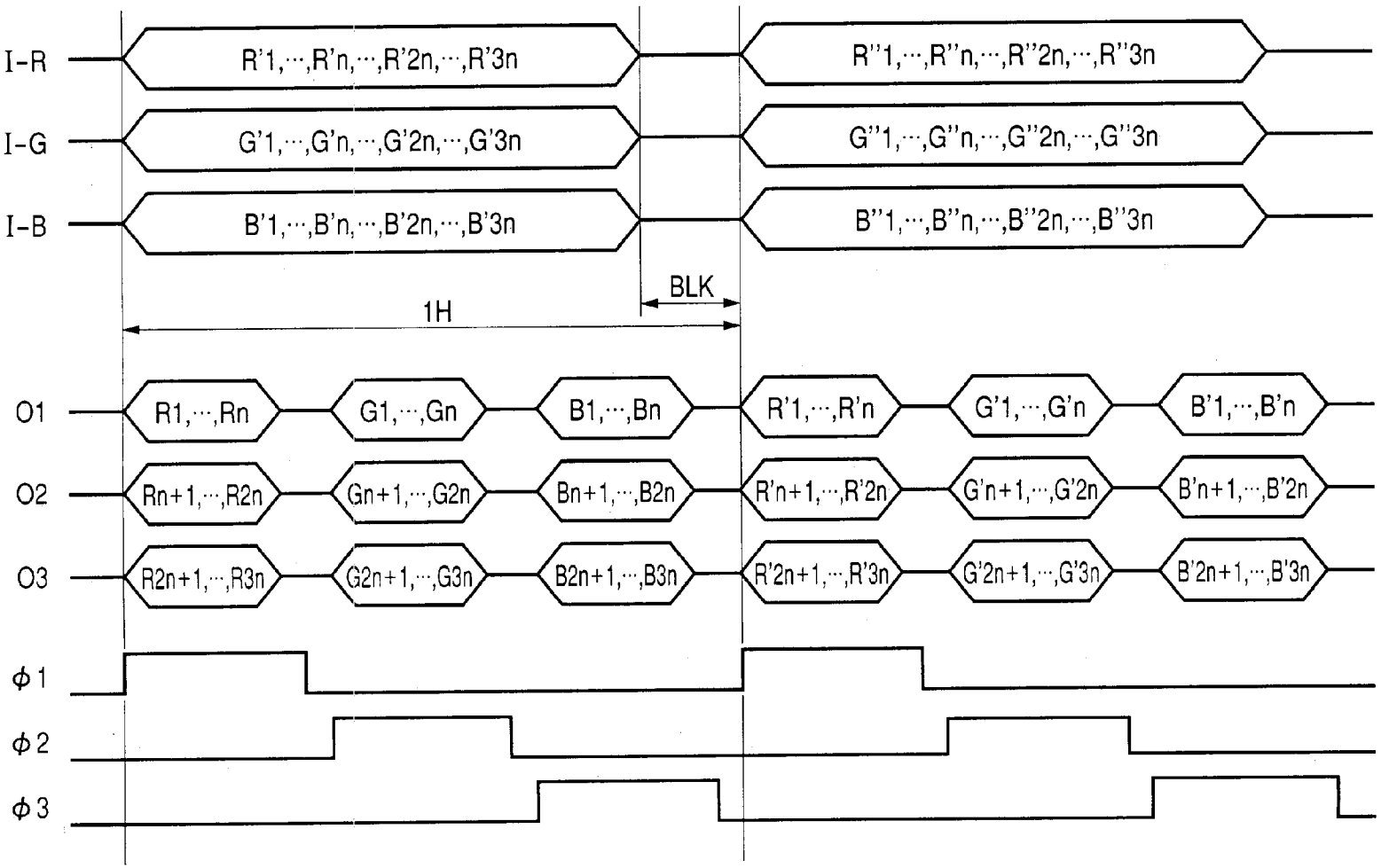
FIG. 17 is a timing chart for explaining the first conventional display device.

FIG. 12 illustrates timings of the signals and data in the embodiment explained in connection with FIG. 11. A major difference between the timings in FIGS. 10 and 12 is a period during which the switching circuits provided to the display blocks are in the ON state. Writing of video signals into pixels in the first display block BK1 is performed even during a period in which writing of video signals into pixels in the second display block BK2 is performed, and is continued until writing of video data into pixels in the third display block BK3 is started from a time t3.

The two buses BL1, BL2 are provided in the embodiment explained in connection with FIGS. 11 and 12, and consequently, sufficient time is available for writing video signals into pixels compared with the case of the fourth embodiment.

In the above explanation, "the top of the display panel PNL" and "the bottom of the display panel PNL" are used by choosing an extending direction of the scanning lines GL to be a horizontal direction without being restrictive as to position in use.

In the fourth and fifth embodiments, the switches included in the switching circuits associated with the display blocks are formed of polysilicon thin film transistors. The drain drivers DRV fabricated on semiconductor chips can be attached directly to the display panel PNL, but the present invention is not limited to this configuration. The drain drivers DRV can be formed of polysilicon on the display panel PNL as in the case of the switching circuits, or can be coupled to the display panel PNL by attaching the drain drivers to a flexible substrate.

Further, "drain bus" and "bus conductors" forming the drain bus are used arbitrarily in this specification, and can be referred to by other names without departing from the spirit and scope of the present invention.

In this embodiment, each of the display blocks is formed of plural adjacent picture dots, but the present invention is not limited to this configuration. For example, the display area DPA can be formed of six display blocks comprising the first, second, third, fourth, fifth and sixth display blocks including (6N+1)st picture dots, (6N+2)nd picture dots, (6N+3)rd picture dots, (6N+4)th picture dots, (6N+5)th picture dots, and (6N+6)th picture dots, respectively, where N=0, 1, 2, . . .

In a case where external equipment is configured to supply video data corresponding to two picture dots in parallel at a time, the configuration can be such that one of the video data corresponding to one of the two picture dots supplied in parallel can be supplied to one of the two drivers DRV1, DRV2, the other of the video data corresponding to the other of the two picture dots can be supplied to the other of the two drivers, and each of the two drivers DRV1, DRV2 operates as explained in the above embodiment.

In the first to fifth embodiments explained above, the thin film transistors included in pixels formed within the display area DPA, and thin film transistors (not shown) included in the gate drivers VSR formed at peripheries of the display area DPA are formed of polysilicon. The switches included in the switching circuits formed between the drain lines DL and the drain drivers DRV at the periphery of the display area DPA are also formed of polysilicon thin film transistors.

Further, it is possible to make characteristics of the thin film transistors formed within the display area DPA different from those of the thin film transistors formed outside of the display area DPA, the thin film transistors formed between the drain lines DL and the drain drivers DRV, for example, although the present invention is not limited to this configuration. By making electron mobility of thin film transistors included in pixels smaller than that of thin film transistors at the peripheries of the display area DPA, it is possible to suppress leakage currents in the thin film transistors of pixels and increase the operating speed of the thin film transistors at the peripheries of the display area DPA. Similarly, characteristics of the thin film transistors included in the gate drivers VSR can be made different from those of the thin film transistors of pixels or the thin film transistors formed between the drain lines DL and the drain drivers DRV. In this specification, polysilicon means a silicon crystallized to a greater extent than amorphous silicon at least, including silicon unlimitedly near to single-crystal silicon, and single-crystal silicon fabricated directly on the display panel PNL is not positively excluded for fabrication of the transistors used in the present invention.

In the first to five embodiments, the two gate drivers VSR are disposed at the left and right sides outside of the display area DPA, they do not need to be operated simultaneously, but they can be configured such that one of the two gate drivers VSR drives odd-numbered ones of the scanning lines GL, and the other of the two gate drivers VSR drives even-numbered ones of the scanning lines GL. This configuration makes possible reduction of the operating speed required of the two gate drivers VSR, and provides a wider latitude in the design or manufacture of the gate drivers VSR. It is needless to say that the present invention is not limited to the configuration in which successive ones of the scanning lines GL are driven by alternate ones of the two gate drivers VSR, and the scanning lines GL can be driven alternately by the two gate drivers VSR every plural ones of the scanning lines GL.

In a display device in which two gate drivers VSR are provide at both the left and right sides outside of the display area DPA, basically only one of the two gate drivers VSR is designed to operate, and if a problem arises in one of the two gate drivers VSR, the other of the two gate drivers VSR can be designed to be used. With this configuration, even if one of the two gate drivers VSR become defective in a fabrication or assembling process, at a time of shipping, the yield rate of the products is improved by using the other of the two gate drivers VSR instead.

Further, the gate drivers VSR can be fabricated on single-crystal silicon semiconductor chips in a conventional manner, and then can be attached directly on the display panel PNL, or the semiconductor chips having the gate drivers VSR fabricated thereon can be attached on a flexible substrate as in the case of a tape carrier package, and then the tape carrier package can be coupled to the display panel PNL Further, in a case where the drain drivers DRV are formed of polysilicon thin film transistors fabricated on the display panel PNL, the whole drain driver DRV need not be formed of polysilicon thin film transistors, the configuration can be such that only the digital-to-analog converters DAC are formed of polysilicon thin film transistors.

Further, in the first to fifth embodiments, the video data supplied from outside of the display device are in digital form, but the first to fifth embodiments can be modified to be supplied with analog data. In this case, a device for converting the analog data to digital data needs to be employed in front of the drain driver DRV.

Further, the display devices of the first to fifth embodiments are applicable to various kinds of display devices including display devices of the organic or inorganic EL type employing electroluminescence elements, in addition to the liquid crystal display devices using liquid crystal.

Among the liquid crystal display devices, there are two types. One of the two types produces a display by generating electric field across a liquid crystal layer sandwiched between pixel electrodes formed on one of two opposing insulating substrates and a counter electrode formed on the other of the two opposing insulating substrates, and thereby driving the liquid crystal layer, and the other of the two types, which is a so-called IPS (In-Plane-Switching) type, produces a display by generating lateral electric fields between the pixel electrodes and a counter electrode formed on the same one of the two opposing insulating substrates sandwiching a liquid crystal layer therebetween, and thereby driving the liquid crystal layer. The configuration and concept of the present invention are applicable to both the two types.

By employing the switching circuits between the drain lines DL and the drain drivers DRV of a display panel, and thereby driving the drain driver in a time-division-multiplexed fashion, a display device is realized which is capable of reducing the number of the drain drivers DRV, and thereby reducing the cost of parts as compared with conventional display devices.

What is claimed is:

1. A display device comprising:

a first display block having n red-associated drain lines, n green-associated drain lines and n blue-associated drain lines, arranged adjacently to each other, n being a natural number equal to or greater than 2;

a second display block having n red-associated drain lines, n green-associated drain lines and n blue-associated drain lines, arranged adjacently to each other, n being a natural number equal to or greater than 2;

a plurality of scanning lines common to said first and second display blocks and intersecting said red-associated, green-associated, and blue-associated drain lines of said first and second display blocks;

a plurality of pixels disposed in vicinities of intersections of said plurality of scanning lines and said red-associated, green-associated, and blue-associated drain lines of said first and second display blocks, a respective one of said plurality of pixels being provided with a thin film transistor having a first terminal thereof coupled to a corresponding one of said red-associated, green-associated, and blue-associated drain lines of said first and second display blocks, a second terminal of said thin film transistor coupled to a corresponding one of said plurality of scanning lines, and a third terminal of said thin film transistor coupled to a pixel electrode of said respective one of said plurality of pixels;

3n drain bus conductors, each of said 3n drain bus conductors being coupled to a corresponding one of said red-associated, green-associated, and blue-associated drain lines of said first display block simultaneously in a first timing via a first switching circuit controlled by a first control signal, and each of said 3n drain bus conductors being coupled to a corresponding one of said red-associated, green-associated, and blue-associated drain lines of said second display block simultaneously in a second timing different from said first timing via a second switching circuit controlled by a second control signal, 3n digital-to-analog converters disposed from said first and second display blocks with said 3n drain bus conductors arranged in-between, each of said 3n digital-to-analog converters being coupled to a respective one of said 3n drain bus conductors;

a latch circuit coupled to said 3n digital-to-analog converters; and a delay device coupled to said latch circuit, wherein said delay device comprises input terminals for receiving digital video data, a third switching circuit having first terminals coupled to said input terminals, a delay circuit which is coupled to said input terminals and delays red-associated, green-associated, and blue-associated digital video data contained in said digital video data supplied from said input terminals, a fourth switching circuit having first terminals coupled to output terminals of said delay circuit, and output terminals coupled to second terminals of said third switching circuit and second terminals of said fourth switching circuit; and wherein said third switching circuit outputs video data corresponding to said plurality of pixels in one of said first and second display blocks, and said fourth switching circuit outputs video data corresponding to said plurality of pixels in another of said first and second display blocks.

2. A display device according to claim 1, wherein said first switching circuit and said second switching circuit are polysilicon thin film transistors.

3. A display device according to claim 1, wherein said delay device is fabricated on a single semiconductor chip.

4. A display device according to claim 1, wherein said delay device, said latch circuit, and said n digital-to-analog converters are fabricated on a single semiconductor chip.

5. A display device according to claim 1, wherein m drain lines among said n drain lines of said first and second display blocks, respectively, and pixels among said plurality of pixels associated with said m drain lines are common to said first and second display blocks.

* * * * *